US011079136B2

(12) United States Patent
Swanson et al.

(10) Patent No.: US 11,079,136 B2
(45) Date of Patent: Aug. 3, 2021

(54) CONDENSATE MANAGEMENT MANIFOLD AND SYSTEM

(71) Applicant: 3M INNOVATIVE PROPERTIES COMPANY, St. Paul, MN (US)

(72) Inventors: Steven P. Swanson, Blaine, MN (US); Kurt J. Halverson, Lake Elmo, MN (US); Caleb T. Nelson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 62 days.

(21) Appl. No.: 16/471,004

(22) PCT Filed: Dec. 18, 2017

(86) PCT No.: PCT/IB2017/058072
§ 371 (c)(1),
(2) Date: Jun. 19, 2019

(87) PCT Pub. No.: WO2018/116133
PCT Pub. Date: Jun. 28, 2018

(65) Prior Publication Data

US 2020/0080747 A1 Mar. 12, 2020

Related U.S. Application Data

(60) Provisional application No. 62/436,801, filed on Dec. 20, 2016.

(51) Int. Cl.
*F25D 21/14* (2006.01)
*F24F 13/22* (2006.01)

(52) U.S. Cl.
CPC ..... *F24F 13/222* (2013.01); *F25D 21/14* (2013.01)

(58) Field of Classification Search
CPC ..... F24F 13/222; F25D 21/14
See application file for complete search history.

(56) References Cited

U.S. PATENT DOCUMENTS 5,197,238 A 3/1993 Peleg
5,514,120 A 5/1996 Johnston
(Continued)

FOREIGN PATENT DOCUMENTS

CN 101945811 A 1/2011
EP 0425757 9/1993
(Continued)

OTHER PUBLICATIONS

International Search Report for PCT International Application No. PCT/IB2017/058072, dated Apr. 13, 2018, 2 pages.
(Continued)

*Primary Examiner* — Filip Zec
(74) *Attorney, Agent, or Firm* — Qiang Han

(57) ABSTRACT

A condensation management manifold includes a first portion having a first elongated channel comprising a first condensate flow channel. A second portion of the manifold has second elongated channel comprising a second condensate flow channel. The second portion is configured to nest at least partially within the first portion such that a first surface of a flexible condensate management film is fluidically coupled to the first flow channel and an oppositely oriented second surface of the condensate management film is fluidically coupled to the second flow channel.

16 Claims, 16 Drawing Sheets

(56) References Cited

U.S. PATENT DOCUMENTS

| | | | | |
|---|---|---|---|---|
| 5,585,186 | A | 12/1996 | Scholz | |
| 5,728,446 | A | 3/1998 | Johnston | |
| 6,372,323 | B1 | 4/2002 | Kobe | |
| 6,372,954 | B1 | 4/2002 | Johnston | |
| 6,375,871 | B1 | 4/2002 | Bentsen | |
| 6,420,622 | B1 | 7/2002 | Johnston | |
| 6,531,206 | B2 | 3/2003 | Johnston | |
| 6,746,567 | B2 | 6/2004 | Johnston | |
| 6,803,090 | B2 | 10/2004 | Castiglione | |
| 7,418,827 | B2 * | 9/2008 | Rios | F24F 13/222 220/571 |
| 7,878,019 | B2 * | 2/2011 | Cantolino | F24F 13/222 62/285 |
| 8,418,719 | B2 * | 4/2013 | Tabata | B01F 13/0066 137/599.03 |
| 8,769,979 | B2 * | 7/2014 | Timbs | F24F 13/222 62/288 |
| 9,777,962 | B2 * | 10/2017 | Mastroianni | F28F 9/013 |
| 10,378,813 | B2 * | 8/2019 | Meuler | B08B 3/10 |
| 2003/0019617 | A1 * | 1/2003 | Hoffmeister | D06F 58/26 165/162 |
| 2005/0106360 | A1 | 5/2005 | Johnston et al. | |
| 2007/0003443 | A1 * | 1/2007 | Sandell | B01L 3/0275 422/400 |
| 2007/0139451 | A1 | 6/2007 | Somasiri | |
| 2009/0242048 | A1 | 10/2009 | Sherman | |
| 2012/0023709 | A1 | 2/2012 | Hsu | |
| 2012/0175082 | A1 * | 7/2012 | Kmetovicz | F24S 10/95 165/104.21 |
| 2016/0265807 | A1 | 9/2016 | Platt | |
| 2018/0106049 | A1 * | 4/2018 | Jay | E04B 1/7629 |

FOREIGN PATENT DOCUMENTS

| | | |
|---|---|---|
| EP | 0511717 | 10/1994 |
| EP | 1126755 | 6/2003 |
| EP | 1 547 460 A1 | 6/2005 |
| EP | 2522212 | 9/2015 |
| FR | 2929353 | 4/2010 |
| JP | 2004344174 A | 12/2004 |
| JP | 2011-050316 | 3/2011 |
| NL | 9300966 | 1/1994 |
| NL | 1012483 | 10/2000 |
| NL | 1034948 | 7/2009 |
| WO | WO 00/25571 | 5/2000 |
| WO | WO 2015-164632 | 10/2015 |

OTHER PUBLICATIONS

Extended European Search Report, EP 17 88 4671, dated Jun. 30, 2020, 2 pages.

* cited by examiner

CONDENSATE MANAGEMENT MANIFOLD AND SYSTEM

CROSS REFERENCE TO RELATED APPLICATIONS

This application is a national stage filing under 35 U.S.C. 371 of PCT/IB2017/058072, filed Dec. 18, 2017, which claims the benefit of U.S. Provisional Application No. 62/436,801, filed Dec. 20, 2019, the disclosure of which is incorporated by reference in its entirety herein.

TECHNICAL FIELD

This application relates to condensate management systems and to devices and methods related to such systems.

BACKGROUND

Persistent condensation can be a problem within a building infrastructure, causing water damage, mold or mildew-related contamination, safety hazards, and corrosion. A common source of condensation inside building infrastructure is "sweaty" surfaces. Condensation is particularly troublesome in food processing facilities where the presence of moisture can lead to the proliferation of microorganisms. Droplets of condensation that form on and are released from condensate producing surfaces can transfer the microorganisms in the condensation to underlying processing equipment or food products. This microbiological contamination can lead to accelerated product spoilage or foodborne illness.

BRIEF SUMMARY

In accordance with some embodiments described herein, a condensation management manifold includes a first portion having a first elongated channel comprising a first condensate flow channel. A second portion of the manifold has second elongated channel comprising a second condensate flow channel. The second portion is configured to nest at least partially within the first portion such that a first surface of a flexible condensate management film is fluidically coupled to the first flow channel and an oppositely oriented second surface of the condensate management film is fluidically coupled to the second flow channel.

Some embodiments are directed to a condensation management system. The system includes a condensation management manifold, a condensation management film support (which may be a second manifold), and a flexible condensation management film disposed between the manifold and the support. The manifold includes a first portion that has a first elongated channel comprising a first condensate flow channel and a second portion that has a second elongated channel comprising a second condensate flow channel. The second portion is configured to nest within the first elongated channel such that a first surface of the film is fluidically coupled to the first channel and an oppositely oriented second surface of the film is fluidically coupled to the second channel.

Some embodiments are directed to a condensation management system that includes a flexible trapezoidal condensation management film having a plurality of attachment features. Mounts respectively coupled to the attachment features of the flexible condensation management film. The mounts are configured to position and hold the film relative to a condensate producing surface such that the film is curved along a lateral axis of the film and a bottom of the curved condensate management film slopes downward along the direction of gravity.

These and other aspects of the present application will be apparent from the detailed description below. In no event, however, should the above summaries be construed as limitations on the claimed subject matter, which subject matter is defined solely by the attached claims.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DESCRIPTION OF ILLUSTRATIVE EMBODIMENTS

Figure 1A:
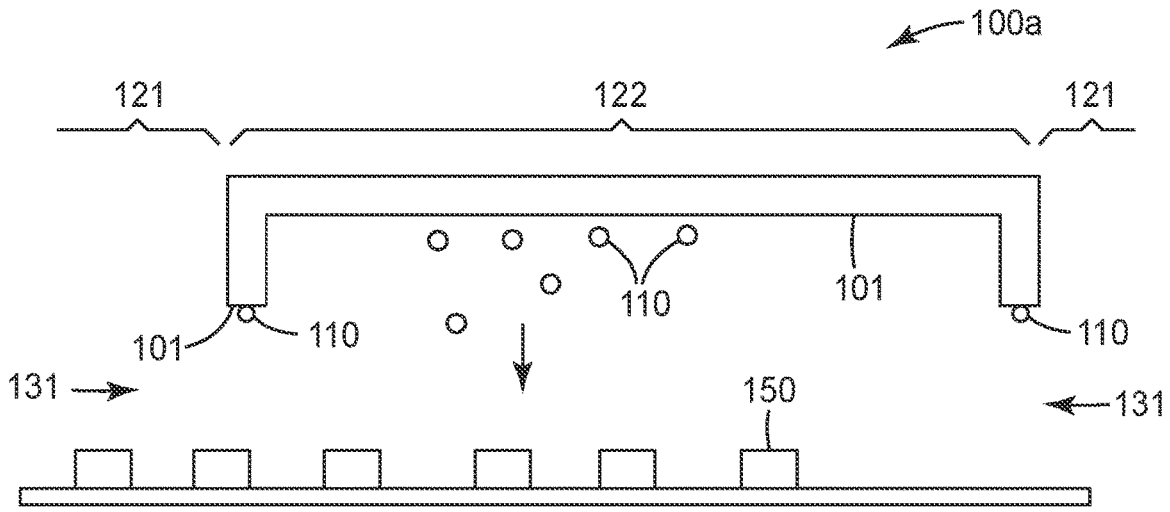
FIG. 1A is a conceptual view of a processing facility that includes surfaces upon which condensate droplets form due to the temperature differential between at least one first region and at least one second region.

FIG. 1A is a conceptual view of a processing facility 100*a* that includes surfaces 101 upon which condensate droplets 110 form due to the temperature differential between at least one first region 121 and at least one second region 122. For example, first regions 121 may be at room temperature and second region 122 may be a cold storage such that the temperature of regions 121 is greater than the temperature of region 122. Product, e.g., a food product 150 moves from the room temperature regions 121 into and/or out of the cold storage region 122 along path 199. Due to the temperature difference between the two regions 121, 122, condensate 110 forms on surfaces at the openings 131 between the room temperature regions 121 and the cold storage region 122 and within the cold storage region 122. Eventually, the condensate 122 coalesces and drops onto the food product 150. Condensate 110 falling on the food product 150 is a mechanism for food contamination and a vehicle for increasing the water activity of low water content foods that would otherwise not pose a substantial bacterial growth concern. Because of this risk, governmental agencies require food processors to manage condensation throughout their facilities.

Several approaches to manage condensation that forms on overhead surfaces in food processing facilities have previously been employed. Previous approaches involve periodically shutting down the manufacturing line to defrost the cold storage region, drying the condensate producing surfaces using an absorbent material such as a mop head attached to an extension pole, and/or using a squeegee or compressed air to remove the condensate. Other approaches include using expensive "air knife" systems that attempt to minimize the flow of warm air into the cold infeed and discharge areas. However, most of these systems require manual intervention and may need to stop production in order to mitigate condensate.

Approaches disclosed herein are directed to condensate management devices and systems that involve flexible films used with manifolds that continuously route condensate away from food products. The approaches disclosed herein can be used to mitigate condensation in a processing facility without shutting down production and/or without using physical mopping or drying techniques to remove the condensate.

Figure 1B:
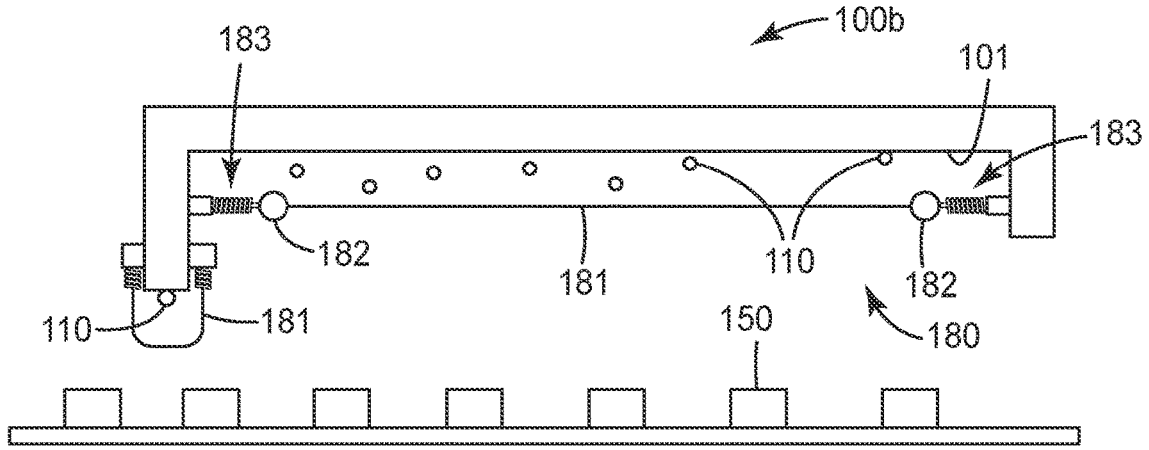
FIG. 1B illustrates a processing facility with a condensate management system according to some embodiments.

FIG. 1B illustrates a processing facility 100*b* in which a condensate management system 180 described herein is installed. Condensate 110 is blocked from falling on food products 150 by one or more flexible films 181 suspended under the condensate producing surfaces 101 such that condensate 110 that forms on the condensate producing surfaces 101 falls onto the film 181. According to some embodiments, the condensate management system 180 includes at least one manifold 182 fluidically coupled to the film 181 and configured to route the captured condensate 110 away from the food product 150. Mounts 183 position and hold the flexible film 181 relative to the condensate producing surface 101.

Figure 2A:
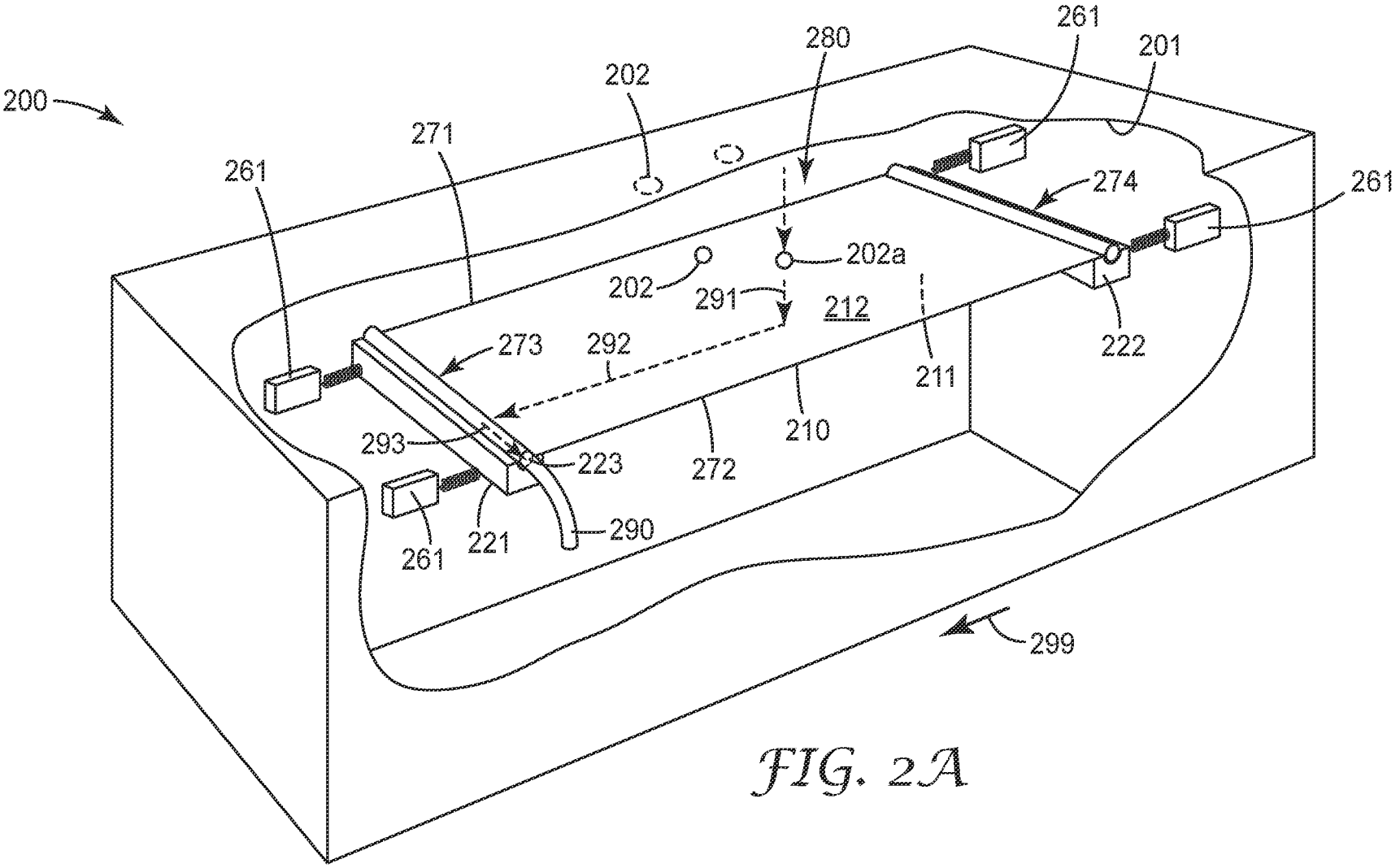
FIG. 2A is a cut away perspective view of a portion of a processing facility having a condensate management system in accordance with some embodiments.
Figure 2B:
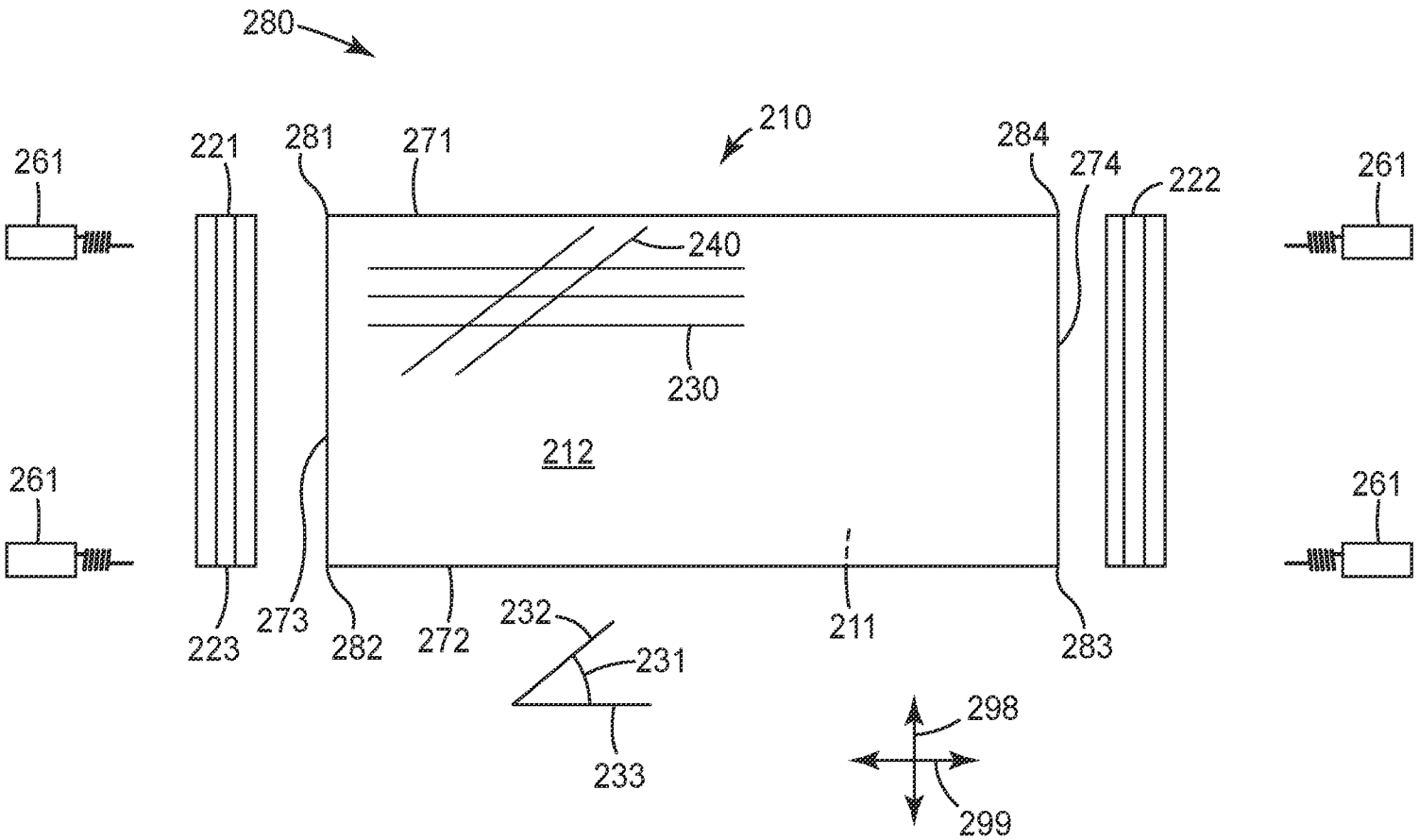
FIG. 2B is an exploded top view of the condensate management system of FIG. 2A.

FIG. 2A is a cut away perspective view of a portion 200 of a processing facility having a condensate management system 280 in accordance with some embodiments. FIG. 2B is an exploded top view of the condensate management system 280. The system 280 is configured to collect and transport condensate and comprises a fluid control film 210, which may include a hydrophilic surface, at least one manifold, and mounts 261. The manifold collects and releases condensate that is transported via topside 212 and underside 211 of a sloped film 210, e.g., to a single release site. The mounts 261 and manifold simultaneously provide a mechanism to tension a "floating" flexible film which allows for reduced susceptibility to freezing by thermally decoupling the film and/or other system structures from the cold surfaces.

FIGS. 2A and 2B show a flexible fluid control film 210 arranged between first and second supports 221, 222. One or both of the supports 221, 222 may comprise a manifold that collects and releases condensate. In some embodiments, the flexible fluid control film 210 may be a quadrilateral or rectangle having first side 271, an opposing second side 272, a third side 273, and an opposing fourth side 274. The flexible film 281 has a lateral axis 298 that intersects first 271 and second 272 sides and a longitudinal axis 299 that intersects the third 273 and fourth 274 sides. As shown in FIG. 2B, the film 210 may include a first corner 281 between first 271 and third 273 sides, a second corner 282 between third 273 and second 272 sides, a third corner 283 between second 272 and fourth 274 sides, and a fourth corner 284 between fourth 274 and first 271 sides. As shown in FIG. 2A, the supports 221, 222 position and hold the flexible film 210 relative to a condensate producing surface 201 such that condensate 202 that forms on the condensate producing surface 201 falls onto the second surface 212 of the flexible film 210. Some condensate may also form on the opposing, first surface 211 of the flexible film 210.

The supports 221, 222 are configured to be attached respectively to two opposing sides 273, 274 of the film 210. In some embodiments, both of the supports 221, 222 are manifolds fluidically coupled to the film 210 such that condensate 202 that falls on the second surface 212 of the film 210 is routed into the manifold 221, 222. In some embodiments, it is possible that one of supports 221, 222 serves only as a support and does not include the fluidic features of the manifold. In some embodiments, both supports 221, 222 are manifolds and have fluidic features, but the condensation is routed so that only one of the supports 221, 222 collects the condensation.

The dashed arrows 291, 292, 293 show the route of a water droplet 202*a* that falls from the ceiling of the processing facility 200. The water droplet 202*a* falls downward 291 along the direction of gravity until the droplet 202*a* reaches the second surface 212 of the film 210. The film 210 is angled downward with respect to gravity along its longitudinal axis 299. At the film surface 212, the droplet 202*a* may coalesce with other droplets and flow 292 generally along the longitudinal axis 299 of the film 210 until the droplet 202*a* reaches the manifold 221. The droplet 202*a* enters the manifold 221 and flows 293 generally along the lateral axis 298 of the film 210 until the droplet 202*a* exits through the exit port 223 of the manifold 221.

Mounts 261 are mechanically coupled to the supports 221, 222. The mounts 261 are configured and arranged to position and hold the supports 221, 222 relative to the condensate producing surface 201 such that condensate 202 that forms on the condensate producing surface 201 falls from the condensate producing surface 201 onto the second surface 212 of the film 210.

Consider a condensation management system 280 that includes a first manifold 221 disposed on one side 273 of the film that is configured to collect the condensation and a second manifold 222 disposed on another side 274 of the film 210 that serves only as a support and does not collect a substantial amount of condensation. The mounts 261 may be arranged so that the side 273 of the film 210 that is attached to the first manifold is lower along the gravitational direction than the opposing side 274 that is attached to the second manifold 222. In some embodiments, the mounts 261 may be arranged so that one corner 282 of the flexible film 210 is the lowest point. The lowest corner 282 may be attached to the end of the manifold 221 that is attached to a drain tube 290, for example, facilitating draining of the manifold 221. In some embodiments, the manifold 221, 222 may include one or more features, such as a threaded or tapered section at the end of the manifold, the one or more features configured to facilitate connection of the drain tube 290.

In some embodiments, the major surfaces 211, 212 of the flexible film 210 may be substantially smooth. In some embodiments, microstructures 230, 240 are disposed on one or both of the first major surface 211 and the second major surface 212 of the flexible film 210. The microstructures 230, 240 may be microchannels configured to facilitate movement of condensate toward the manifold 221 and/or to wick condensate to enhance evaporation. FIG. 2B shows a first set of microchannels 230 and a second set of 240 microchannels, wherein the microchannels 230, 240 may be fluidically connected.

As illustrated in FIG. 2B, the longitudinal axes of the microchannels 230 lie along line 233 and the longitudinal axes of the channels 240 lie along line 232. Channels 240 make a channel angle, 231, with respect to the channels 240 as shown in FIG. 2B. In some embodiments, the longitudinal axes of microchannels 230 are substantially aligned with the longitudinal axis 299 of the film. In some embodiments, the angle 231 of at least some of the microchannels 240 may be greater than 0 degrees and less than about 90 degrees, or greater than 0 degrees and less than about 60 degrees for example. In some embodiments, the channel angle 231 is less than about 45 degrees.

According to some embodiments, the microchannels 230, 240 are configured to provide capillary movement of fluid in the channels 230, 240 longitudinally along the flexible film 210 and/or laterally across the flexible film 210. Capillary action that wicks the fluid laterally disperses the fluid across the film 210 so as to increase the surface to volume ratio of the fluid and enable more rapid evaporation. The channel cross-section, channel surface energy, and fluid surface tension determine the capillary force.

Figure 3:
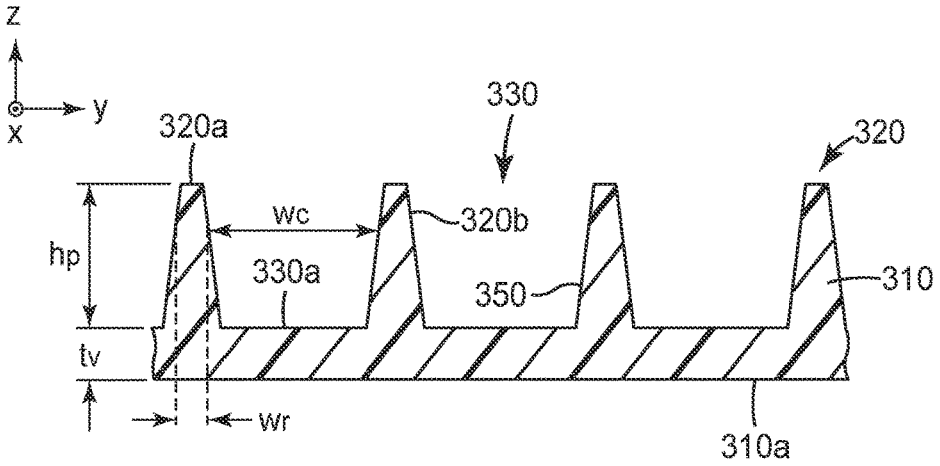
FIGS. 3-5 are cross sectional diagrams that illustrate fluid control films having microchannels in accordance with various embodiments.
Figure 4:
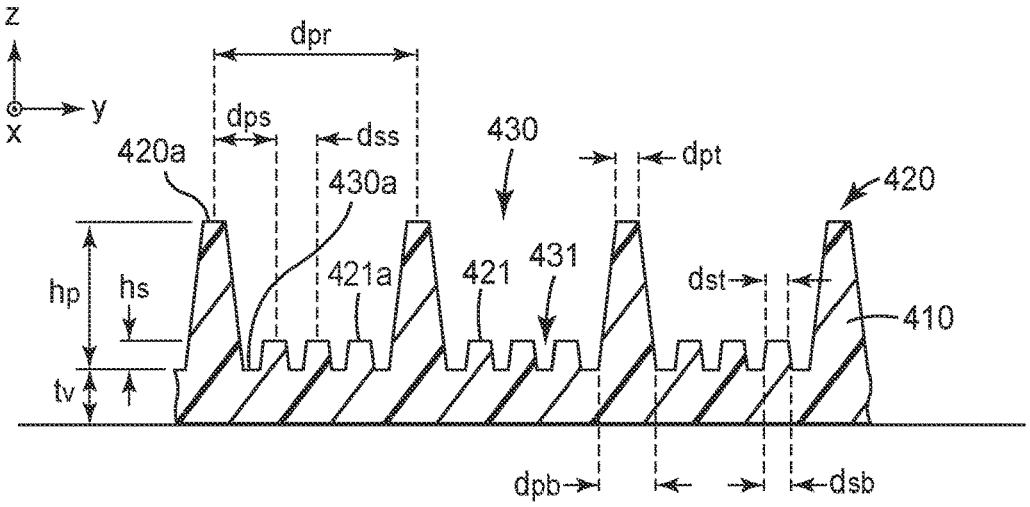
Figure 5:
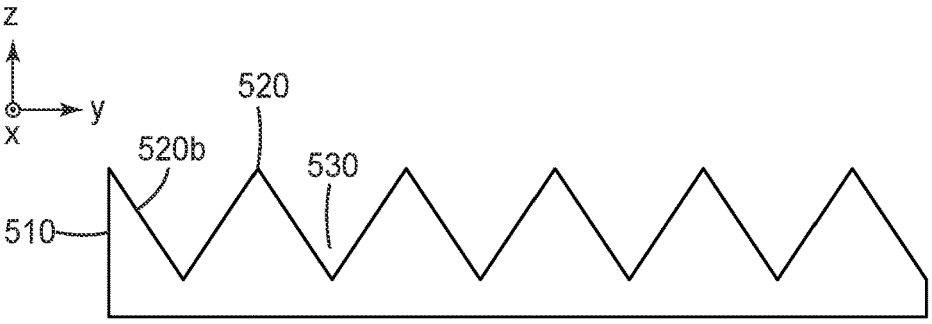

FIGS. 3-5 are cross sectional diagrams that illustrate fluid control films having microchannels in accordance with various embodiments. As shown in FIG. 3, ridges 320 rise along the z-axis above the base 330*a* of the film 310 to form the microchannels 330, with each channel 330 having a ridge 320 on either side running along the channel longitudinal axis which is the x-axis in FIG. 3. The channel longitudinal axis may be substantially parallel to or at an angle with the longitudinal axis of the film. In FIG. 3, the ridges 320 are shown rising along the z-axis substantially perpendicular to the base 330*a* of the channel 330. Alternatively, in some embodiments, the ridges can extend at a non-perpendicular angle with respect to the base of the channel. The ridges 320 of the channel 330 have a height, $h_p$ that is measured from the base surface 330*a* of the channel 330 to the top surface 320*a* of the ridges 320. The ridge height $h_p$ may be selected to provide durability and protection to the film 310. In some embodiments, the ridge height $h_p$ is about 25 μm to about 1000 μm, or about 100 μm to about 200 μm, the cross sectional channel width, $w_c$, is about 25 μm to about 1000 the cross sectional ridge width, $w_r$, is about 30 μm to about 250 μm.

In some embodiments, as shown in FIG. 3, the side surfaces 320*b* of the channels 330 may be sloped in cross section so that the width of the ridge at the base surface 330*a* of the channel 330 is greater than the width of the ridge at the top surface 320*a* of the ridges 320. In this scenario, the width of the channel 330 at the base 330*a* of the channel 330 is less than the width of the channel 330 at the top surface 320*a* of the ridges 320. Alternatively, the side surfaces of the channels could be sloped so that the channel width at the bottom surface of the channel is greater than the channel width at the top surface of the ridges.

The distance, $t_v$, between the base surface 330*a* of the channel 330 and the opposing surface 310*a* of the film 310 can be selected to allow liquid droplets to be wicked by the film 310 but still maintain a robust structure. In some embodiments, the thickness G is less than about 75 μm thick, about 50 μm thick, or between about 20 μm to about 200 μm thick. In some embodiments, hydrophilic surface structure or coating 350 may be disposed, e.g., coated or plasma deposited, on the base 330*a*, the channel sides 320*b*, and/or the channel tops 320*a*. In some embodiments, each set of adjacent ridges 320 are equally spaced apart. In other embodiments, the spacing of the adjacent ridges 320 may be at least two different distances apart.

FIG. 4 is a cross sectional view of a flexible film 410 having primary 430 and secondary 431 channels according to an example embodiment. The primary and secondary channels 430, 431 are defined by primary and secondary ridges 420, 421. The channels 430, 431 and ridges 420, 421 run along a channel longitudinal axis which is the x axis in FIG. 4. The channel longitudinal axis may be substantially parallel to or at an angle with the longitudinal axis of the film. Each primary channel 430 is defined by a set of primary ridges 420 (first and second) on either side of the primary channel 430. The primary ridges 420 have a height, $h_p$, that is measured from the base surface 430*a* of the channel 430 to the top surface 420*a* of the ridges 420.

In some embodiments, microstructures are disposed within the primary channels 430. The microstructures may comprise secondary channels 431 disposed between the first and secondary primary ridges 420 of the primary channels 430. Each of the secondary channels 431 is associated with at least one secondary ridge 421. The secondary channels 431 may be located between a set of secondary ridges 421 or between a secondary ridge 421 and a primary ridge 420.

The center-to-center distance between the primary ridges, $d_{pr}$, may be in a range of about 25 μm to about 1000 μm; the center-to-center distance between a primary ridge and the closest secondary ridge, $d_{ps}$, may be in a range of about 5 μm to about 350 μm; the center-to-center distance between two secondary ridges, $d_{ss}$, may be in a range of about 5 μm to about 350 μm. In some cases, the primary and/or secondary ridges may taper with distance from the base. The distance between external surfaces of a primary ridge at the base, $d_{pb}$, may be in a range of about 15 μm to about 250 μm and may taper to a smaller distance of $d_{pt}$ in a range of about 1 μm to about 25 μm. The distance between external surfaces of a secondary ridge at the base, $d_{sb}$, may be in a range of about 15 μm to about 250 μm and may taper to a smaller distance of $d_{st}$ in a range of about 1 μm to about 25 μm. In one example, $d_{pp}$=0.00898 inches (228 μm), $d_{ps}$=0.00264 inches (67 μm), $d_{ss}$=0.00185 inches (47 μm), $d_{pb}$=0.00251 inches (64 μm), $d_{pt}$=0.00100 inches (25.4 μm), $d_{sb}$=0.00131 inches (33.3 μm), $d_{st}$=0.00100 inches (25.4 μm), $h_p$=0.00784 inches (200 μm), and $h_s$=0.00160 inches (40.6 μm).

The secondary ridges 421 have height $h_s$ that is measured from the base surface 430*a* of the channel 430 to the top surface 421*a* of the secondary ridges 421. The height $h_p$ of the primary ridges 420 may be greater than the height $h_s$ of the secondary ridges 421. In some embodiments the height of the primary ridges is between about 25 μm to about 1000 μm or between about 100 μm to about 200 μm and the height of the secondary ridges is between about 5 μm to about 350 μm, or between about 20 μm to about 50 μm. In some embodiments, a ratio of the secondary ridge 421 height $h_s$ to the primary ridge 420 height $h_p$ is about 1:5. In some embodiments, $h_s$ is less than half of $h_p$. The primary ridges 420 can be designed to provide durability to the film 410 as well as protection to the secondary channels 431, secondary ridges and/or or other microstructures disposed between the primary ridges 420. The flexible film 410 may be configured to disperse fluid across the surface of the film 410 to facilitate evaporation of the fluid.

FIG. 5 illustrates a cross section of a condensate control film 510 with ridges 520 and channels 530 according to an example embodiment. The channels 530 are v-shaped with ridges 520 that define the channels 530. In this embodiment, the side surfaces 520*b* of the channels 530 are disposed at an angle greater than 0 and less than 90 degrees, e.g., 20, 40, or 40 degrees, with respect to the axis normal to the layer surface, i.e., the z-axis in FIG. 5. As previously discussed, the channels 530 and ridges 520 of the film 510 may lie along a channel axis that is substantially parallel to or that makes an angle with respect to the longitudinal axis of the film 510. The ridges 520 may be equal distance apart from one another in some embodiments.

The channels described herein may be replicated in a predetermined pattern that form a series of individual open capillary channels extending along one or both major surfaces of the film. These microreplicated channels formed in sheets or films are generally uniform and regular along substantially each channel length, for example from channel to channel. The film or sheet may be thin, flexible, cost effective to produce, can be formed to possess desired material properties for its intended application The flexible films discussed herein may be capable of spontaneously transporting fluids along the channels by capillary action. Two general factors that influence the ability of fluid control films to spontaneously transport fluids are (i) the geometry or topography of the surface (capillarity, size and shape of the channels) and (ii) the nature of the film surface (e.g., surface energy). To achieve the desired amount of fluid transport capability the designer may adjust the structure or topography of the fluid control film and/or adjust the surface energy of the fluid control film surface. In order for a channel to function for fluid transport by spontaneous wicking by capillary action, the channel is generally sufficiently hydrophilic to allow the fluid to wet the surfaces of the channel with a contact angle between the fluid and the surface of the fluid control film equal to or less than 90 degrees.

In some implementations, the fluid control films described herein can be prepared using an extrusion embossing process that allows continuous and/or roll-to-roll film fabrication. According to one suitable process, a flowable material is continuously brought into line contact with a molding surface of a molding tool. The molding tool includes an embossing pattern cut into the surface of the tool, the embossing pattern being the microchannel pattern of the fluid control film in negative relief. A plurality of microchannels is formed in the flowable material by the molding tool. The flowable material is solidified to form an elongated fluid control film that has a length along a longitudinal axis and a width, the length being greater than the width. The microchannels can be formed along a channel longitudinal axis that makes an angle that is greater than 0 and less than 90 degrees with respect to the longitudinal axis of the film. In some embodiments, the angle is less than 45 degrees, for example.

The flowable material may be extruded from a die directly onto the surface of the molding tool such that flowable material is brought into line contact with the surface of molding tool. The flowable material may comprise, for example, various photocurable, thermally curable, and thermoplastic resin compositions. The line contact is defined by the upstream edge of the resin and moves relative to both molding tool and the flowable material as molding tool rotates. The resulting fluid control film may be a single layer article that can be taken up on a roll to yield the article in the form of a roll good. In some implementations, the fabrication process can further include treatment of the surface of the fluid control film that bears the microchannels, such as plasma deposition of a hydrophilic coating as disclosed herein. In some implementations, the molding tool may be a roll or belt and forms a nip along with an opposing roller. The nip between the molding tool and opposing roller assists in forcing the flowable material into the molding pattern. The spacing of the gap forming the nip can be adjusted to assist in the formation of a predetermined thickness of the fluid control film. Additional information about suitable fabrication processes for the disclosed fluid control films are described in commonly owned U.S. Pat. Nos. 6,375,871 and 6,372,323, each of which is incorporated by reference herein in its respective entirety.

The fluid control films discussed herein can be formed from any polymeric materials suitable for casting or embossing including, for example, polyethelyne, polypropylene, polyesters, co-polyesters, polyurethane, polyolefins, polyamides, poly(vinyl chloride), polyether esters, polyimides, polyesteramide, polyacrylates, polyvinylacetate, hydrolyzed derivatives of polyvinylacetate, etc. Specific embodiments use polyolefins, particularly polyethylene or polypropylene, blends and/or copolymers thereof, and copolymers of propylene and/or ethylene with minor proportions of other monomers, such as vinyl acetate or acrylates such as methyl and butylacrylate. Polyolefins readily replicate the surface of a casting or embossing roll. They are tough, durable and hold their shape well, thus making such films easy to handle after the casting or embossing process. Hydrophilic polyurethanes have physical properties and inherently high surface energy. Alternatively, fluid control films can be cast from thermosets (curable resin materials) such as polyurethanes, acrylates, epoxies and silicones, and cured by exposure radiation (e.g., thermal, UV or E-beam radiation, etc.) or moisture. These materials may contain various additives including surface energy modifiers (such as surfactants and hydrophilic polymers), plasticizers, antioxidants, pigments, release agents, antistatic agents, and the like. In some cases the channels may be formed using inorganic materials (e.g., glass, ceramics, or metals).

A suitable stiffness of the fluid control film may be in a range of between about 100 pounds of force per inch width and about 1500 pounds of force per inch width. According to some embodiments, the lateral stiffness may be less than the longitudinal stiffness.

In some embodiments, the fluid control film may include a characteristic altering additive or surface coating. Examples of additives include flame-retardants, hydrophobics, hydrophilics, antimicrobial agents, inorganics, corrosion inhibitors, metallic particles, glass fibers, fillers, clays and nanoparticles. The surface of the film may be modified to ensure sufficient capillary forces. For example, the surface may be modified in order to ensure it is sufficiently hydrophilic. The films generally may be modified (e.g., by surface treatment, application of surface coatings or agents), or incorporation of selected agents, such that the film surface is rendered hydrophilic so as to exhibit a contact angle of 90 degrees or less with aqueous fluids or more preferably with a contact angle of 45 degrees or less. According to some embodiments, the flexible film includes a hydrophilic coating on one or both film surfaces comprising an organosilane deposited by plasma enhanced chemical vapor deposition (PECVD).

Any suitable known method may be utilized to achieve a hydrophilic surface on fluid control films of the present invention. Surface treatments may be employed such as topical application of a surfactant, plasma treatment, vacuum deposition, polymerization of hydrophilic monomers, grafting hydrophilic moieties onto the film surface, corona or flame treatment, etc. Alternatively, a surfactant or other suitable agent may be blended with the resin as an internal characteristic-altering additive at the time of film extrusion. Typically, a surfactant is incorporated in the polymeric composition from which the fluid control film is made rather than rely upon topical application of a surfactant coating, since topically applied coatings may tend to fill in (i.e., blunt), the notches of the channels, thereby interfering with the desired fluid flow to which the invention is directed. When a coating is applied, it is generally thin to facilitate a uniform thin layer on the structured surface. An illustrative example of a surfactant that can be incorporated in polyethylene fluid control films is TRITON™ X-100 (available from Union Carbide Corp., Danbury, Conn.), an octylphenoxypolyethoxyethanol nonionic surfactant, e.g., used at between about 0.1 and 0.5 weight percent.

Other surfactant materials that are suitable for increased durability requirements for building and construction applications of the present invention include Polystep® B22 (available from Stepan Company, Northfield, Ill.) and TRITON™ X-35 (available from Union Carbide Corp., Danbury, Conn.).

A surfactant or mixture of surfactants may be applied to the surface of the fluid control film or impregnated into the film in order to adjust the properties of the fluid control film. For example, it may be desired to make the surface of the fluid control film more hydrophilic than the film would be without such a component.

A surfactant such as a hydrophilic polymer or mixture of polymers may be applied to the surface of the fluid control film or impregnated into the film in order to adjust the properties of the fluid control film. Alternatively, a hydrophilic monomer may be added to the film and polymerized in situ to form an interpenetrating polymer network. For example, a hydrophilic acrylate and initiator could be added and polymerized by heat or actinic radiation.

Suitable hydrophilic polymers include: homo and copolymers of ethylene oxide; hydrophilic polymers incorporating vinyl unsaturated monomers such as vinylpyrrolidone, carboxylic acid, sulfonic acid, or phosphonic acid functional acrylates such as acrylic acid, hydroxy functional acrylates such as hydroxyethylacrylate, vinyl acetate and its hydrolyzed derivatives (e.g. polyvinylalcohol), acrylamides, polyethoxylated acrylates, and the like; hydrophilic modified celluloses, as well as polysaccharides such as starch and modified starches, dextran, and the like.

As discussed above, a hydrophilic silane or mixture of silanes may be applied to the surface of the fluid control film or impregnated into the film in order to adjust the properties of the fluid control film. Suitable silanes include the anionic silanes disclosed in U.S. Pat. No. 5,585,186, as well as non-ionic or cationic hydrophilic silanes.

Additional information regarding materials suitable for microchannel fluid control films discussed herein is described in commonly owned U.S. Patent Publication 2005/0106360, which is incorporated herein by reference.

In some embodiments, a hydrophilic coating may be deposited on the surface of the fluid control film by plasma deposition, which may occur in a batch-wise process or a continuous process. As used herein, the term "plasma" means a partially ionized gaseous or fluid state of matter containing reactive species which include electrons, ions, neutral molecules, free radicals, and other excited state atoms and molecules.

In general, plasma deposition involves moving the fluid control film through a chamber filled with one or more gaseous silicon-containing compounds at a reduced pressure (relative to atmospheric pressure). Power is provided to an electrode located adjacent to, or in contact with film. This creates an electric field, which forms a silicon-rich plasma from the gaseous silicon-containing compounds.

Ionized molecules from the plasma then accelerate toward the electrode and impact the surface of the fluid control film. By virtue of this impact, the ionized molecules react with, and covalently bond to, the surface forming a hydrophilic coating. Temperatures for plasma depositing the hydrophilic coating are relatively low (e.g., about 10 degrees C.). This is beneficial because high temperatures required for alternative deposition techniques (e.g., chemical vapor deposition) are known to degrade many materials suitable for multi-layer film 12, such as polyimides.

The extent of the plasma deposition may depend on a variety of processing factors, such as the composition of the gaseous silicon-containing compounds, the presence of other gases, the exposure time of the surface of the fluid control film to the plasma, the level of power provided to the electrode, the gas flow rates, and the reaction chamber pressure. These factors correspondingly help determine a thickness of hydrophilic coating.

The hydrophilic coating may include one or more silicon-containing materials, such as silicon/oxygen materials, diamond-like glass (DLG) materials, and combinations thereof. Examples of suitable gaseous silicon-containing compounds for depositing layers of silicon/oxygen materials include silanes (e.g., $SiH_4$). Examples of suitable gaseous silicon-containing compounds for depositing layers of DLG materials include gaseous organosilicon compounds that are in a gaseous state at the reduced pressures of reaction chamber 56. Examples of suitable organosilicon compounds include trimethylsilane, triethylsilane, trimethoxysilane, triethoxysilane, tetramethylsilane, tetraethylsilane, tetramethoxysilane, tetraethoxysilane, hexamethylcyclotrisiloxane, tetramethylcyclotetrasiloxane, tetraethylcyclotetrasiloxane, octamethylcyclotetrasiloxane, hexamethyldisiloxane, bistrimethylsilylmethane, and combinations thereof. An example of a particularly suitable organosilicon compound includes tetramethylsilane.

After completing a plasma deposition process with gaseous silicon-containing compounds, gaseous non-organic compounds may continue to be used for plasma treatment to remove surface methyl groups from the deposited materials. This increases the hydrophilic properties of the resulting hydrophilic coating.

Additional information regarding materials and processes for applying a hydrophilic coating to a fluid control film as discussed in this disclosure is described in commonly owned U.S. Patent Publication 2007/0139451, which is incorporated herein by reference.

Figure 6A:
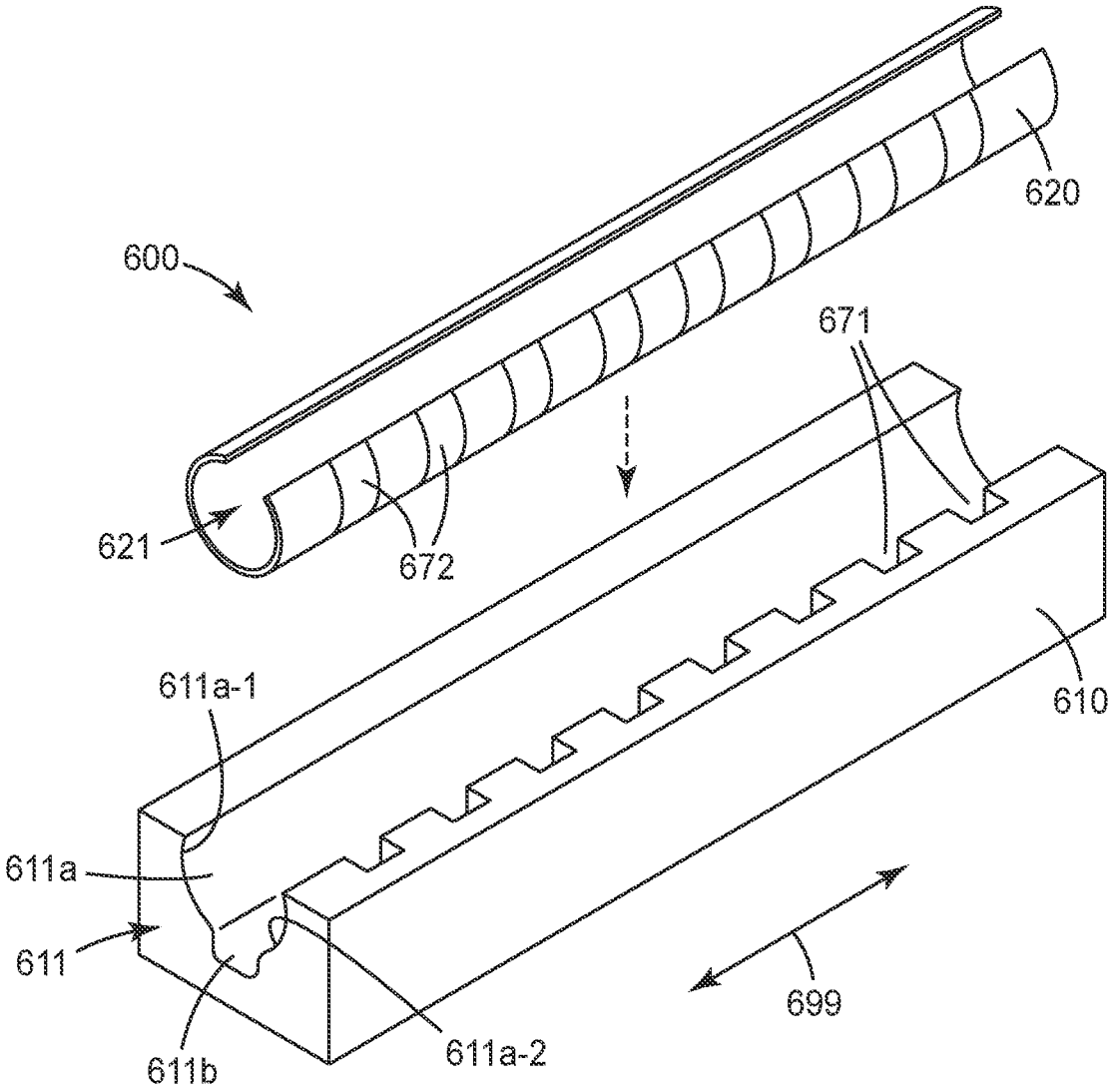
FIGS. 6A through 6D show various views of a manifold in accordance with some embodiments.
Figure 6B:
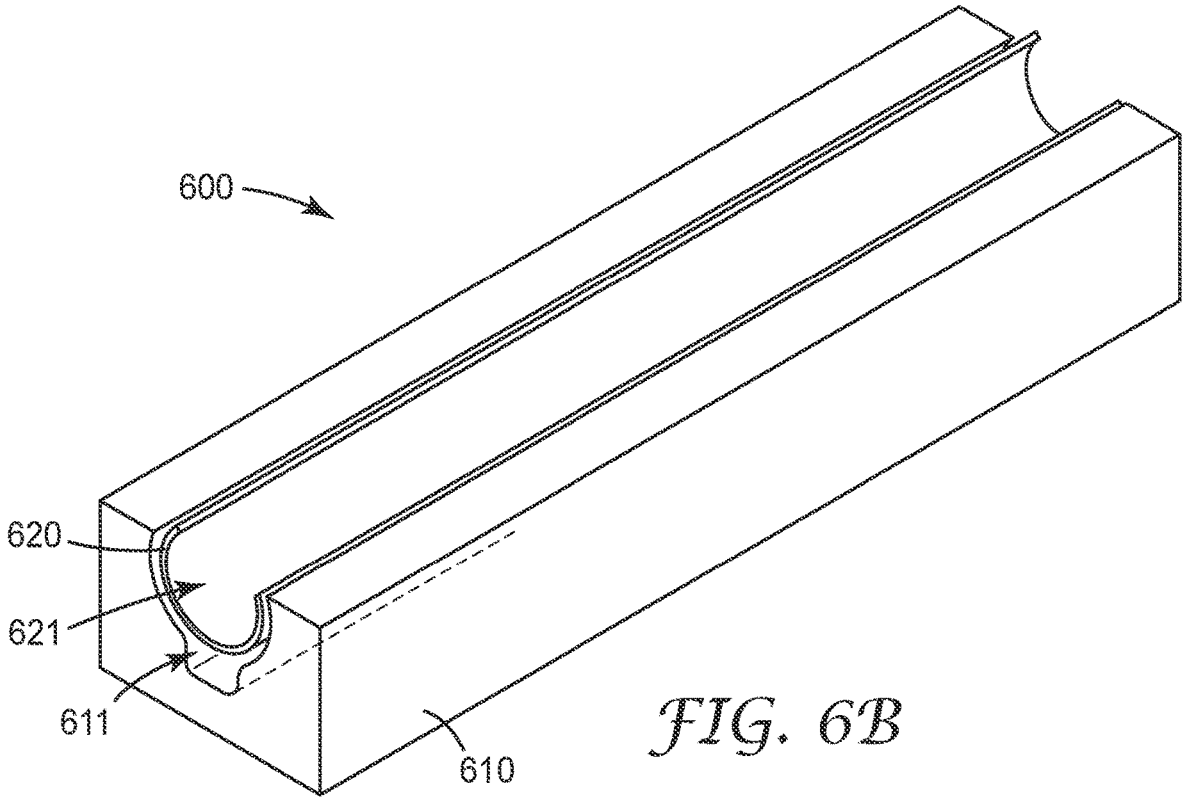

FIGS. 6A through 6D show various views of a manifold 600 in more detail. FIG. 6A is an exploded view of the manifold 600 which includes a first 610 portion comprising a first elongated channel 611 and a second portion 620 comprising a second elongated channel 621. Each of the first and second channels 611, 621 may be substantially straight along a longitudinal axis 699 of the manifold 600. The second portion 620 is configured to nest within the first elongated channel 611 of the first portion 610 as shown in the perspective view of the manifold 600 shown in FIG. 6B.

Figure 6C:
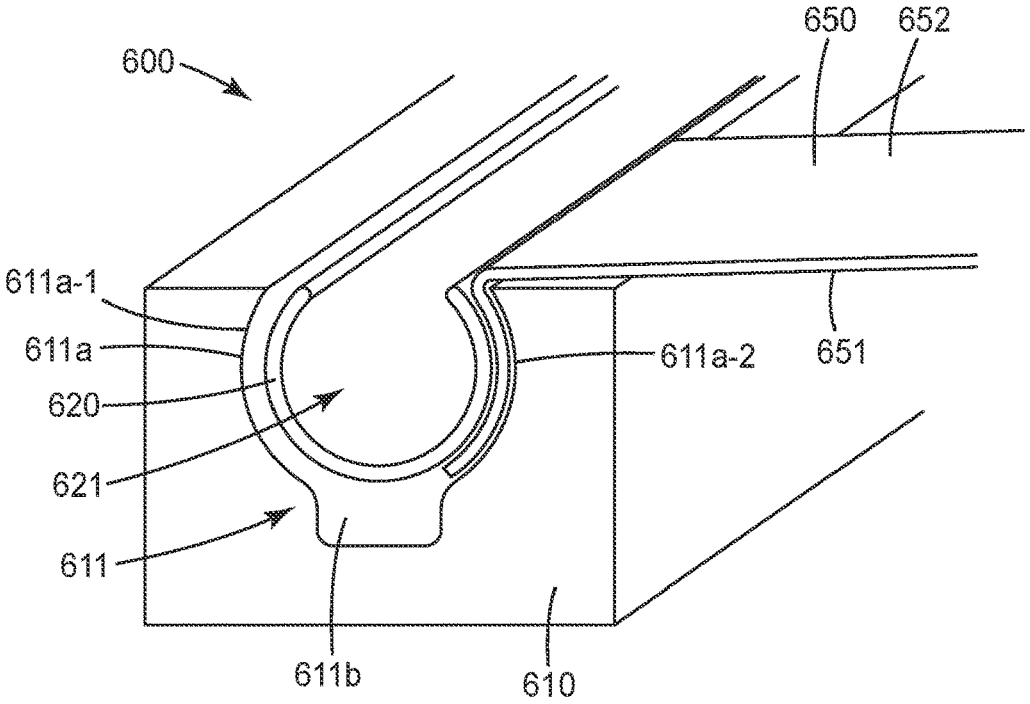
Figure 6D:
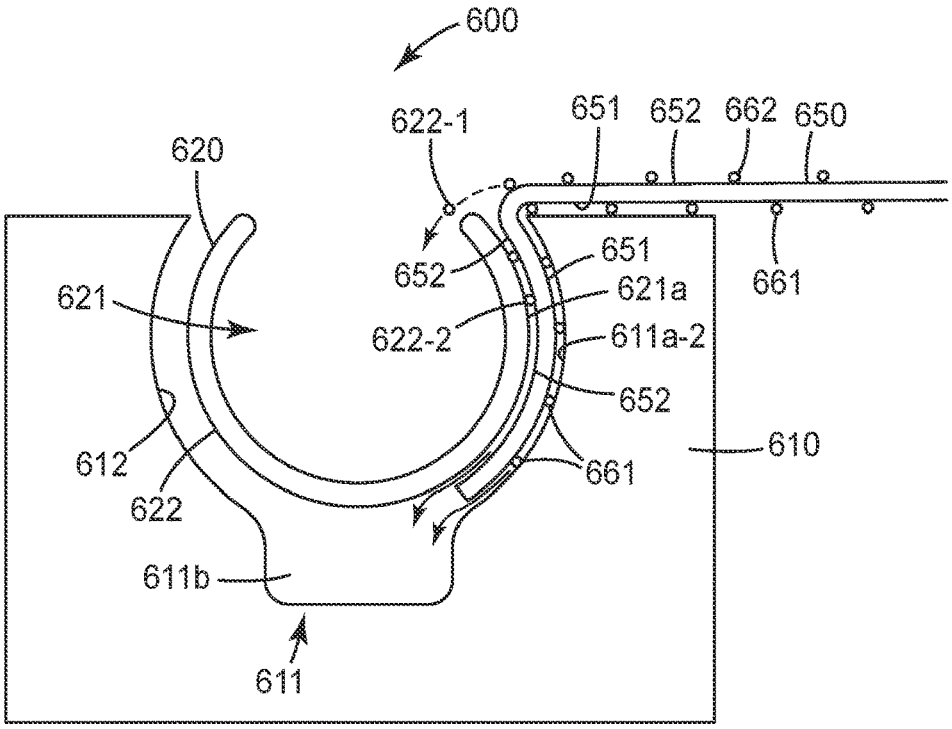

As best seen in the perspective view of FIG. 6C and the end view of FIG. 6D, the manifold 600 is configured to grip a flexible fluid control film 650 between the first portion 610 and the second portion 620 when the first 610 and second 620 portions are nested together. When the first and second portions 610, 620 are nested together, a first surface 651 of a flexible film 650 is fluidically coupled to the first channel 611 and an oppositely oriented second surface 652 of the condensate management film 650 is fluidically coupled to the second channel 621. When the second portion 620 is nested within the first elongated channel 611, the outer surface 622 of second portion 620 and the inner surface 612 of the first portion 610 provide a friction clamp that attaches the flexible film 650 to the manifold 600. In accordance with some embodiments, the friction clamp formed by the nested first and second portions 610, 620 is configured to clamp a flexible film 650 having a thickness of between about 100 microns and about 1000 microns. In some scenarios, the friction clamp is reversible such that the second portion 620 can be removed from the first portion 610 freeing the film 650 from the friction grip of the manifold 600 without substantial damage to the film or the manifold portions.

As best seen in FIG. 6A, when viewed in cross section, first elongated channel 611 includes a first section 611*a* configured to provide the friction clamp when the second channel is nested therein, and a second section 611*b* that forms a first longitudinal condensate flow channel. When viewed in cross section, the first section 611*a* includes two curved sides 611*a*-1, 611*a*-2 that are separated from each other by the flow channel 611*b*. For example, the two curved sides 611*a*-1, 611*a*-2 may each have the shape of a portion of a circle. As illustrated in FIG. 6A, in cross section, the second elongated channel 621 is curved and may form an incomplete circle. The second elongated channel 621 forms the second condensate flow channel. According to some embodiments, there may be one or more optional drain grooves 671, 672 disposed between the interior surface of the first elongated channel 611 and the external surface of the second portion 620 of the manifold 600. The one or more drain grooves 671, 672 are configured to allow condensate from the film 650 (see FIGS. 6D and 6D) to enter the first elongated channel 611. For example, in some embodiments, drain grooves 671 may be formed in the curved portion 611*a*-2 of the first elongated channel 611. In some embodiments, optional drain grooves 672 may be formed in the exterior surface of the second portion 620.

FIG. 6D illustrates the path of droplets of water as the droplets move into the flow channels 611, 621 of the manifold 600. Droplets 662 form or fall on the second surface 652 of the flexible film 650 and travel under the influence of gravity and/or capillary action toward the manifold 600. Some of the droplets 662-1 that form or fall on the second surface 652 travel along the film 650 and into the second channel 621 of the manifold 650. Some of the droplets 662-2 that form or fall on the second surface 652 may travel within the microchannels between the second surface 652 of the film 650 and the external surface 621*a* of the second portion 620 of the manifold 650 and into the flow channel 611*b* of the first portion 610.

Droplets 661 that form on the first surface 651 of the film 650 travel under the influence of gravity and/or capillary action toward the manifold 600. The droplets 661 travel within microchannels of the first surface 651 between the first surface 651 of the film 650 and the curved side 611*a*-2 of the first portion 610 of the manifold and eventually into the flow channel 611*b* of the first manifold portion 610.

The manifold 600 may be any suitable length. For example, the manifold may be between about 5 inches and about 36 inches. In some embodiments, the channels 611, 621 may extend from one end of the manifold 600 to the other end such that the channels 611, 621 are substantially the same length as the manifold 600. As such, each of the channels 611, 621 may also have a length between about 5 inches and about 36 inches. A suitable maximum inner width of between the curved sides 611*a*-1, 611*a*-2 of the first elongated channel 611 is between about 4 millimeters and about 20 millimeters, or about 10 millimeters, for example. A suitable maximum inner width of the second elongated channel 621 may be between about 4 millimeters and about 16 millimeters, or about 8 mm, for example.

Figure 7:
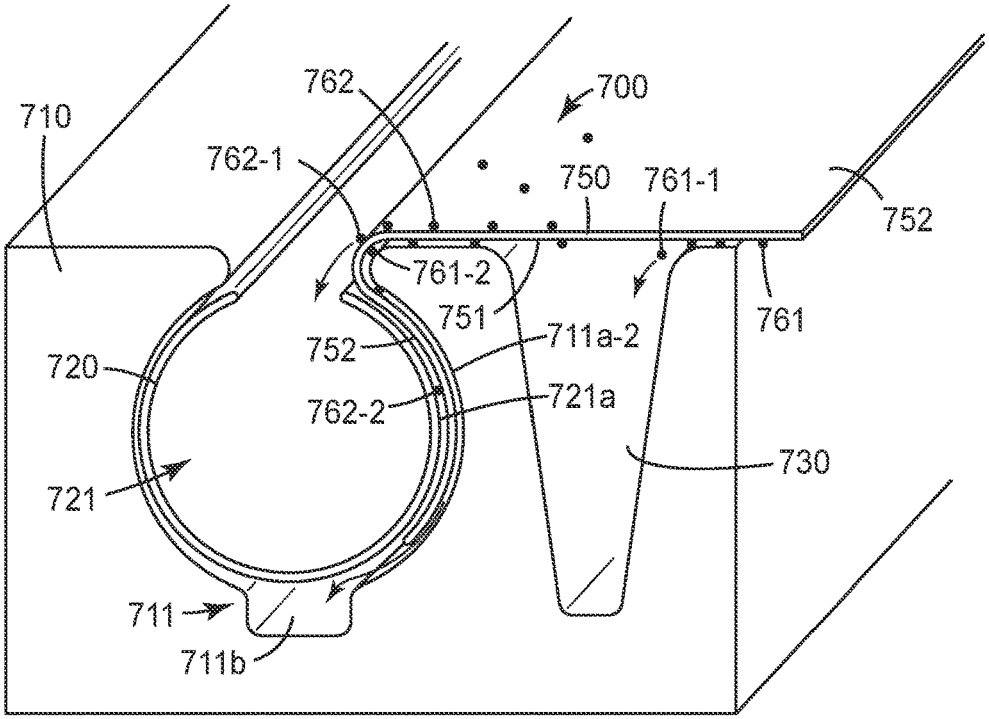
FIG. 7 shows a perspective view of the end region of a manifold attached to a film in accordance with some embodiments.

FIG. 7 shows a perspective view of the end region of a manifold 700 attached to a film 750 in accordance with some embodiments. The manifold 700 includes a first portion 710 having a first channel 711 including a first condensate flow channel 711*b*. The manifold 700 includes a second portion 720 comprising a second condensate flow channel 721, and third condensate flow channel 730 that is substantially parallel to the first 711 and second 721 channels.

Droplets 762 form or fall on the second surface 752 of the flexible film 750 and travel under the influence of gravity and/or capillary action toward the manifold 700. Some of the droplets 762-1 that form or fall on the second surface 752 travel along the film 750 and fall into the second channel 721 of the manifold 750. Some of the droplets 762-2 that form or fall on the second surface 752 may travel within the microchannels between the second surface 752 of the film 750 and the external surface 721*a* of the second portion 720 of the manifold 750 and into the flow channel 711*b* of the first portion 710 of the manifold 700.

Droplets 761 that form on the first surface 751 of the film 750 travel under the influence of gravity and/or capillary action toward the manifold 700. Some of the droplets 761-1 that fall into the third flow channel 730. Some of the droplets 761-2 continue to travel within microchannels of the first surface 751 and eventually flow between the first surface 751 of the film 750 and the curved side 711*a*-2 of the first portion 710 of the manifold 700 and eventually into the flow channel 711*b* of the first manifold portion 710.

Figure 8:
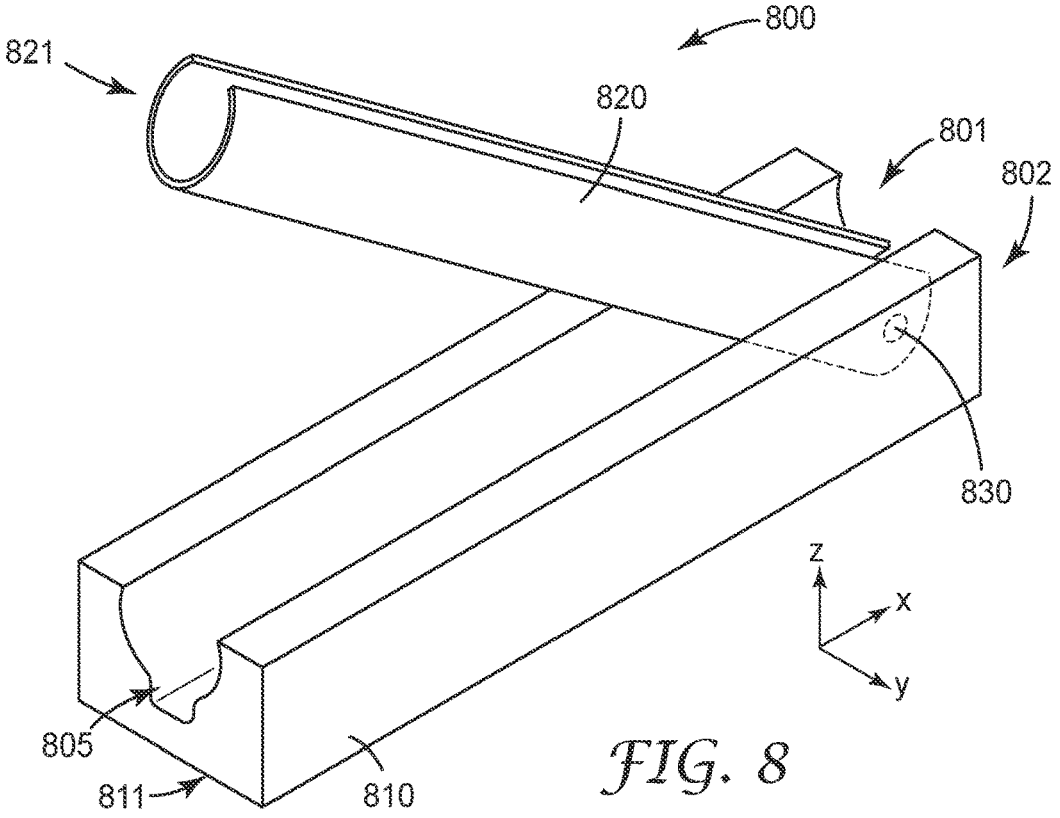
FIG. 8 shows a perspective view of a manifold that includes first and second portions that can rotate relative to one another in accordance with some embodiments.

FIG. 8 shows a perspective view of a manifold 800 that includes a first portion 810 and a second portion 820 that are attached so that the portions can rotate relative to one another. The first portion 810 includes a first end 801 and a second end 811. The second portion 820 includes a first end 802 and a second end 821. In many respects, the manifold 800 of FIG. 8 may be similar to the manifold 600 shown in FIGS. 6A through 6D or the manifold 700 of FIG. 7. The manifold 800 differs in that the first and second portions 810, 820 of manifold 800 are attached together at a first ends 801, 802 of the first and second portions 810, 820. e.g., by a pivot or hinge 830, such that the second portion 820 can rotate relative to the first portion 810 around the lateral axis, which is the y-axis indicated in FIG. 8. The second portion 820 can rotate around the pivot 830 until the second portion 820 nests within the channel 805 of the first portion.

Figure 9A:
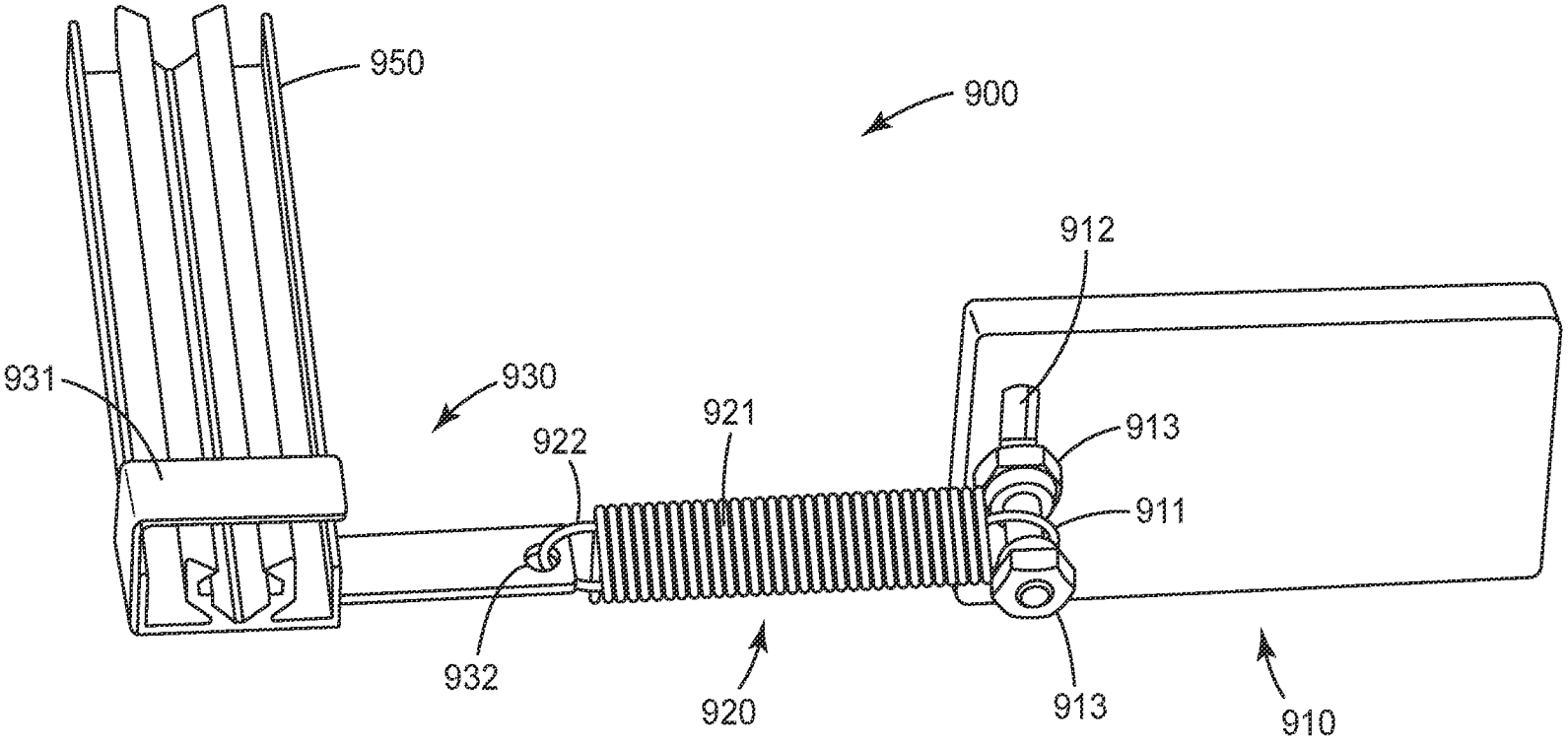
FIGS. 9A and 9B are front and back perspective views of a mount configured to couple to the manifold (or film support) that grips a flexible film in accordance with some embodiments.
Figure 9B:
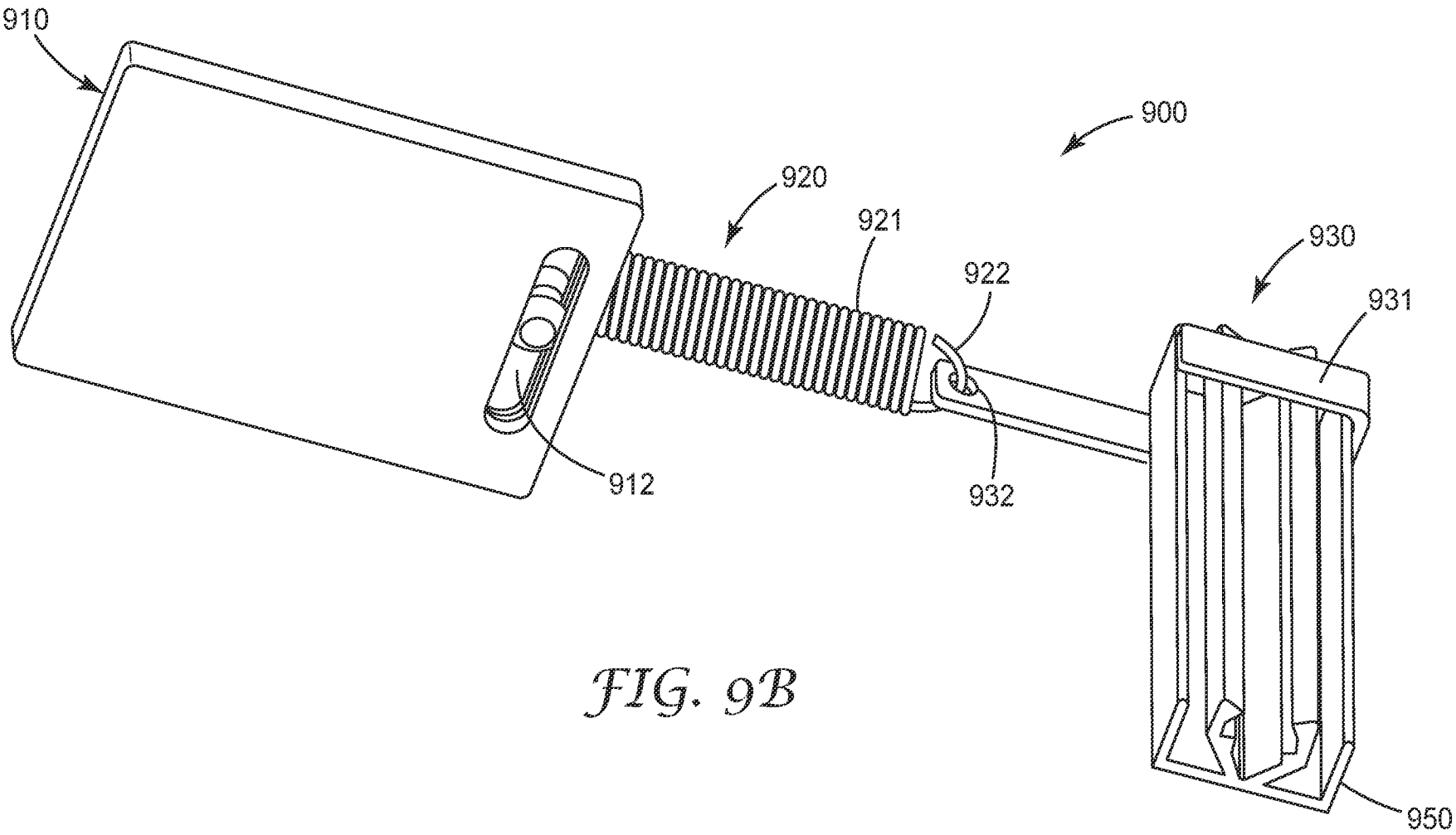

FIGS. 9A and 9B are front and back perspective views of a mount 900 configured to couple to the manifold 950 (or film support) that grips a flexible film (not shown in FIGS. 9A and 9B). The mounts and manifolds provide a mechanism to tension a "floating" material which allows for reduced susceptibility to freezing of the manifold and/or film by thermally decoupling the manifold and/or film from the cold surfaces.

Figure 10:
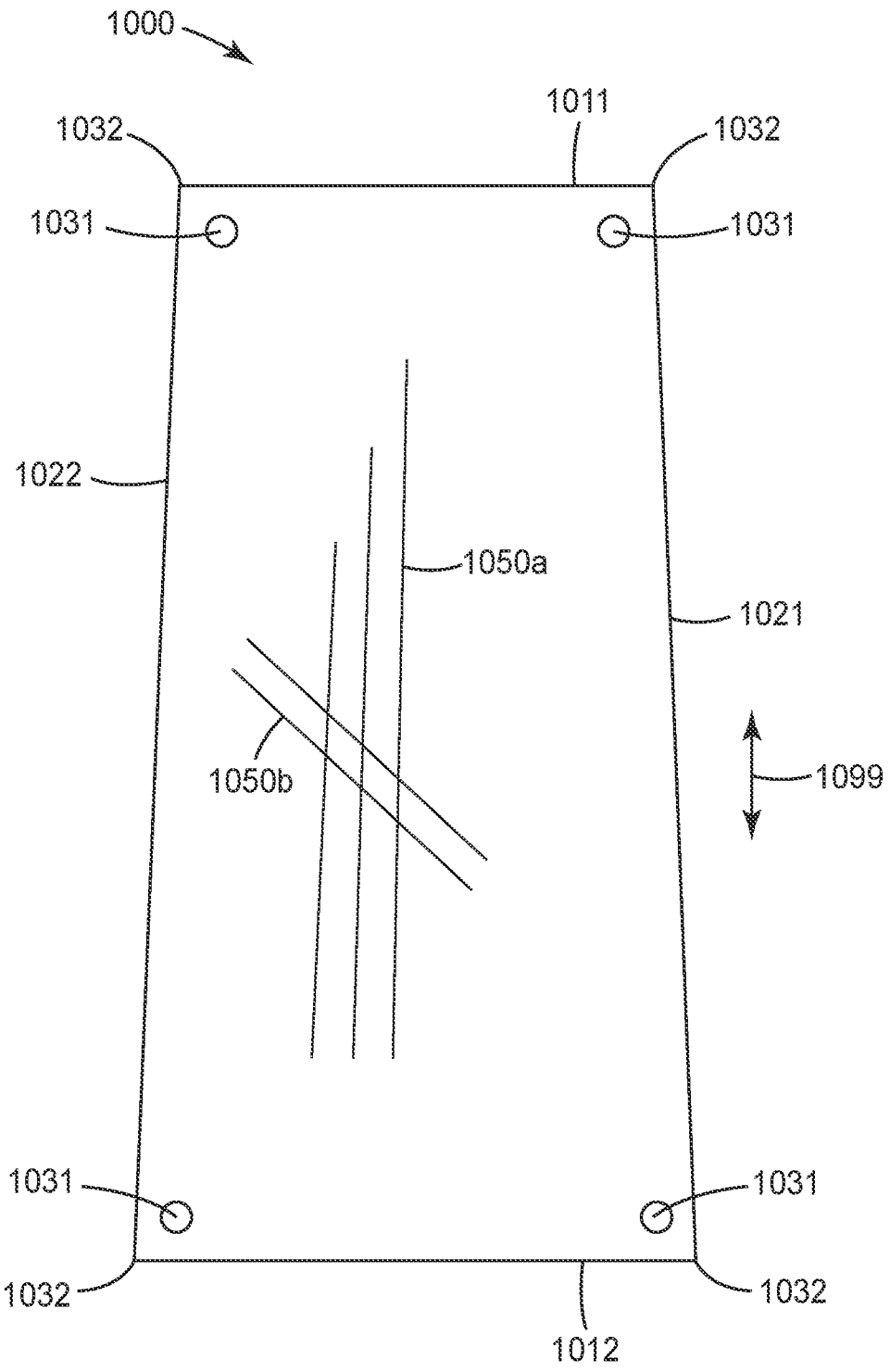
FIG. 10 depicts a flexible film that is laid flat according to some embodiments.
Figure 11:
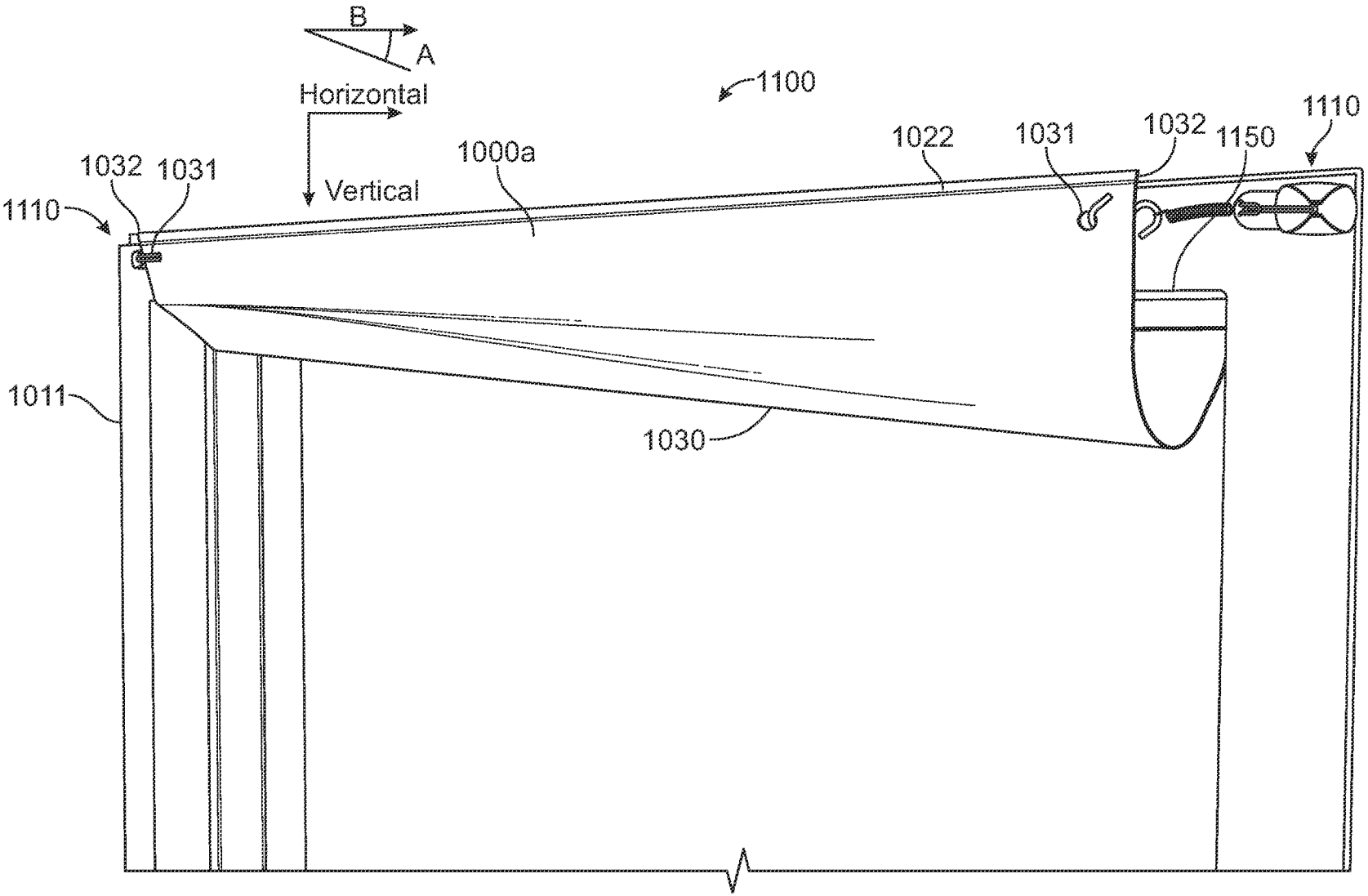
FIG. 11 shows a condensate management system including a mount attached directly to a the flexible film of FIG. 10 in accordance with some embodiments.

The mount 900 may be attached to a structure, e.g., a wall, ceiling, or other structure, to position and hold the flexible film relative to a condensate producing surface such that condensate that forms on the condensate producing surface falls onto a surface of the flexible film. As illustrated in FIGS. 9A and 9B, the mount 900 may include a base portion 910, a middle portion 920, and an attachment portion 930. The base portion 910 can be attached to the structure, e.g., wall, ceiling, or other structure. For example, the base portion 910 may be permanently or removably attached to the structure by fasteners, e.g., nails, screws, rivets, hooks etc., by a friction connector, by adhesive, by welding, brazing, or soldering or by any other suitable means. The attachment portion 930 has an attachment element 931 that is configured to attach to the manifold 950 or directly to the film as shown in FIGS. 10 and 11. For example, the attachment element 931 may comprise a hook as shown in FIGS. 9A and 9B, or another suitable attachment element.

The middle portion 920 is disposed between the attachment portion 930 and the base portion 910. According to some embodiments, the middle portion 920 may comprise a resilient component 921, such as a spring or an elastic strap or bungee. The resilient component 921 is configured to provide tensioning of the flexible film. As shown in FIGS. 9A and 9B, the resilient portion 921 of the middle portion 920 may be attached to a bolt or rod 911 inserted through a hole 912 in the base portion and secured by one or more nuts 913.

Features on the mount 900 may facilitate thermal decoupling between the manifold 950 and the structure to which the base portion 910 is mounted. For example, according to some embodiments, thermal decoupling may be enhanced when one or more of the portions 910, 920, 930 is or comprises a thermal insulator, such as a rubber, plastic or nylon. In some embodiments, an insulator material may be inserted between the base portion 910 and the structure upon which it is mounted, for example. Additionally or alternatively, a thermal insulator could be inserted between the base portion 910 and the middle portion 920 and/or between the middle portion 920 and the attachment portion 930.

Additionally or alternatively, one or more of the junctions between the base portion 910 and the middle portion 920 and/or between the middle portion 920 and the attachment portion 930 and/or another location of the mount may limit thermal coupling by having a small cross sectional connection area between the portions 910, 920, 930. One or more small cross sectional connection areas can serve to thermally decouple the structure from the manifold 950. FIGS. 9A and 9B illustrate a small cross sectional connection area between the middle portion 920 and the attachment portion comprising a spring end 922 of the middle portion 920 inserted into a hole 932 of the attachment portion 930.

In some embodiments, a mount similar to the mount 900 illustrated in FIGS. 9A and 9B may be useful to position a flexible fluid control film relative to a condensate producing surface even in scenarios where a manifold is not used. As can be appreciated from FIGS. 10 and 11, a mount can be directly coupled to the film 1000 in some implementations. FIG. 10 depicts a flexible film 1000 that is laid flat. Although other shapes are possible, in the illustrated embodiment, the flexible film 1000 is an elongated trapezoid. The film 1000 has a first end 1011 and an opposing second end 1012, a first side 1021 extending from the first end 1011 to the second 1012 end, and a second side 1022 extending between the first end 1011 and the second end 1210. In the embodiment depicted in FIG. 10, the width of the film 1000 at the first end 1011 is less than a width of the film 100 at the second end 1012. The first and second ends 1011, 1012 are substantially parallel and the first and second sides 1021, 1022 are non-parallel. There are attachment features 1031, disposed proximate to each corner 1032 of the film 1000. As shown in FIG. 10, in some implementations, the attachment features 1031 are holes through the film 100, although other types of attachment features could be employed.

FIG. 11 shows a condensation management system 1100 that includes the flexible film 1000 illustrated in FIG. 10. The flexible film 1000 is positioned and held by one or more mounts 1110 coupled to the ends 1011, 1012 of the flexible film 1000. The mounts 1110 are arranged hold the flexible film 1000 relative to a condensate producing surface 1150 such that the flexible film 1000 is curved laterally between the first 1021 and second 1022 sides. The mounts can be similar to the mounts shown in FIGS. 9A and 9B. As can be seen in FIG. 11, the mounts 1110 may be coupled directly to attachment features 1031 disposed at corners of the film 1000, such as holes in the film. For example, an attachment element 931 of a mount 900 as shown in FIG. 9A may be inserted into each of the four holes 1031 in the film with the bases 910 of the mounts attached to a structure, such as the door frame, or other structure.

When mounted, the flexible film 1000 has a concave surface and an opposing convex surface 1000*a*. The flexible film 1000 is positioned and held by the mounts 1110 relative to a condensate producing surface 1150 such that condensate that forms on the surface 1050 falls onto the concave surface 1000*a* of the film 1000. According to some embodiments, microchannels 1050*a*, 1050*b*, as previously discussed, are disposed on one or both of the concave surface and the convex surfaces of the film. Microchannels 1050*a* having longitudinal axes that are substantially parallel to the longitudinal axis 1099 of the film may facilitate moving the condensate along the film toward a drain at the lowest end of the film. Microchannels 1050*b* having longitudinal axes that are angled with respect to the longitudinal axis 1099 of the film may be useful to spread the condensate out by wicking condensate in the channels in opposition to gravity. Spreading the condensate out facilitates faster drying of the condensate. In some scenarios, as previously discussed, the concave and or convex film surfaces may have a hydrophilic layer or surface structure.

The bottom 1030 of the curved film 1000 slopes downward from the first end 1011 to the second end 1012 along a direction of gravity along the vertical axis. The predetermined slope of the film as positioned as shown in FIG. 11 is A/B where A is the distance that the bottom of the film drops vertically and B is the length of the film along the horizontal axis. The slope of the film 1000 may depend on the size and configuration of the condensation producing structure. As illustrated in FIG. 11, the condensation management system 1100 is positioned to manage condensation that forms on the header portion of a door. A film with longitudinal capillary channels 1050*a* can transport liquid at a much lower slope than a film without the longitudinal channels. Therefore, films with longitudinal capillary channels 1050*a* may be arranged to have a smaller slope than films having no longitudinal channels or only angled channels. In some embodiments, the slope of the film A/B may be in a range of about 0.01 to about 0.2.

EXAMPLES

Figure 12:
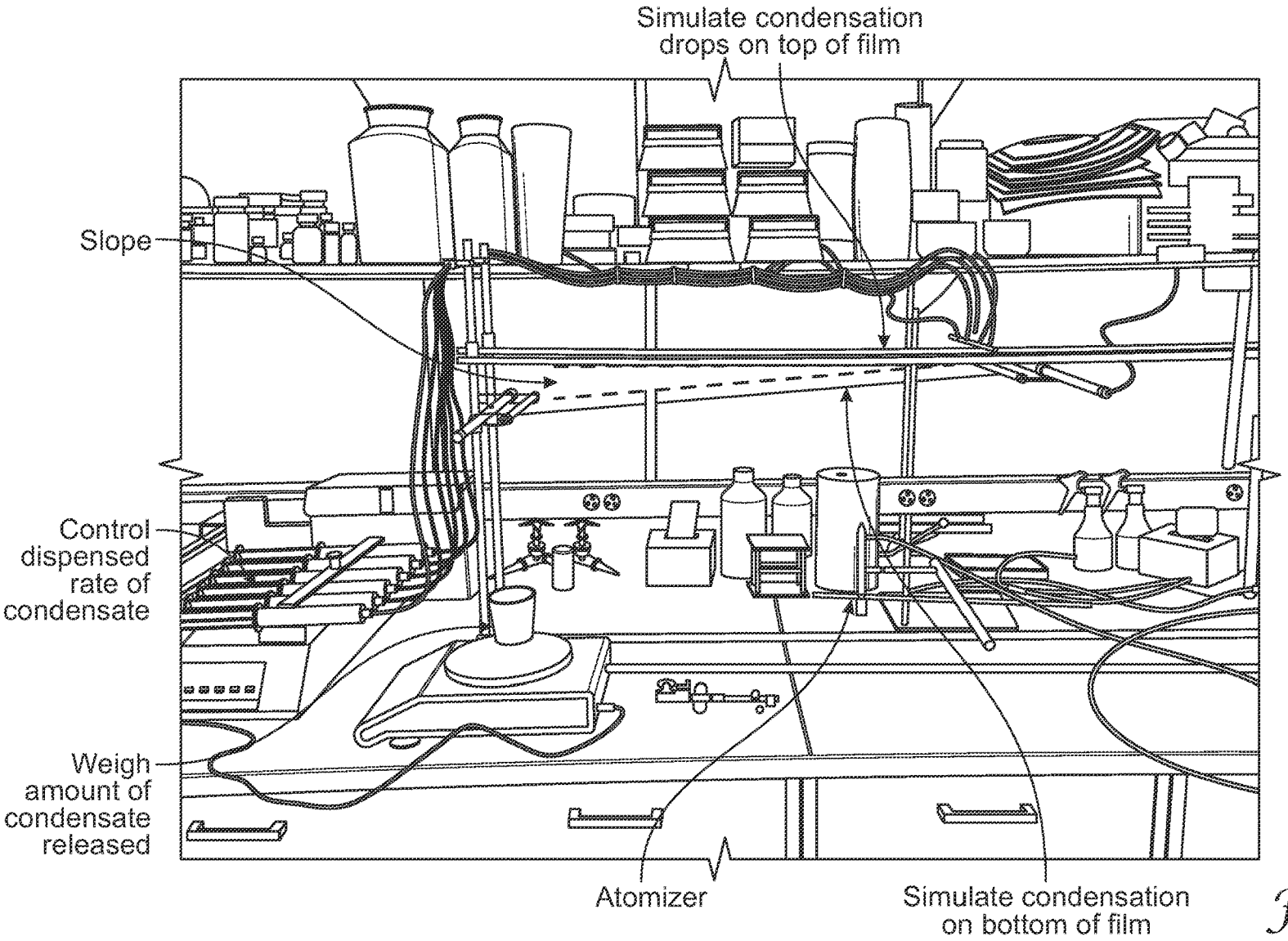
FIGS. 12-17 are photographs showing various views of a test apparatus in which a flexible film was tensioned and held at a slope between two manifolds.
Figure 13:
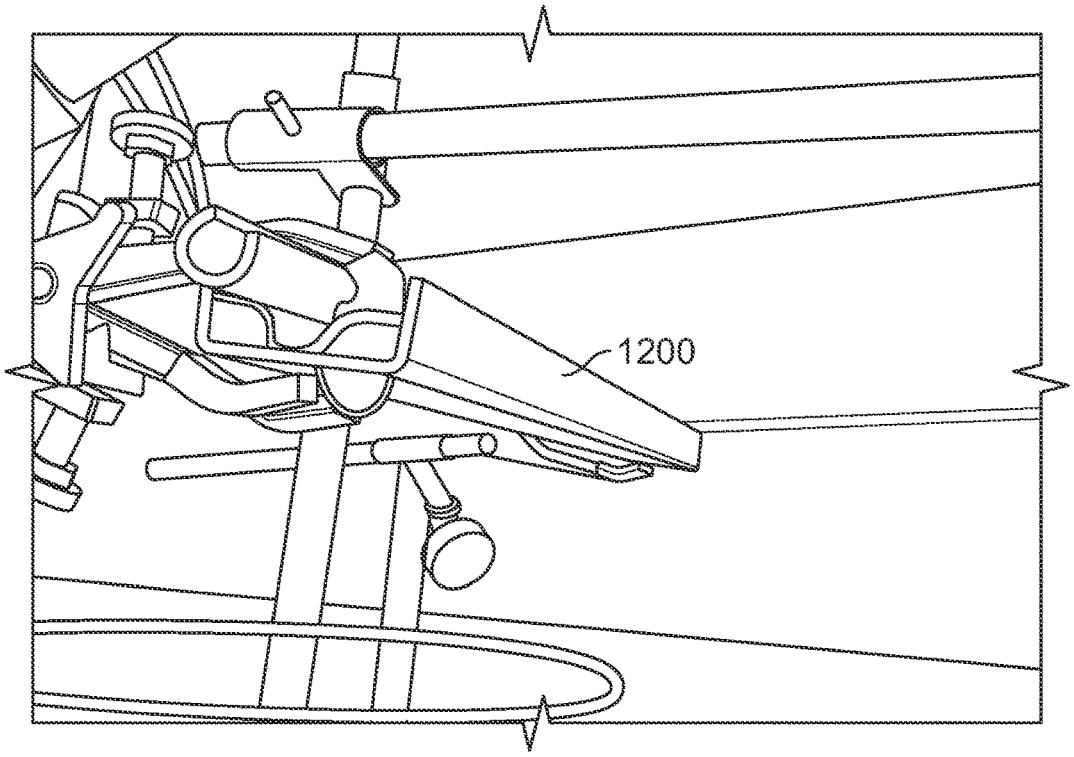
Figure 14:
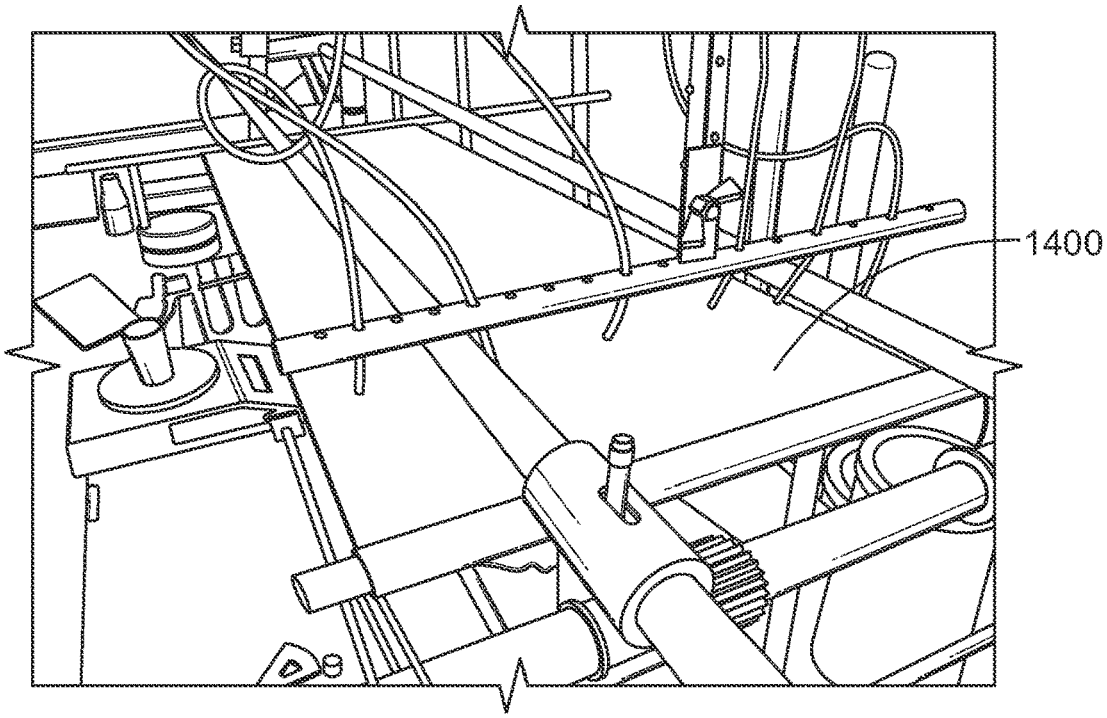
Figure 15:
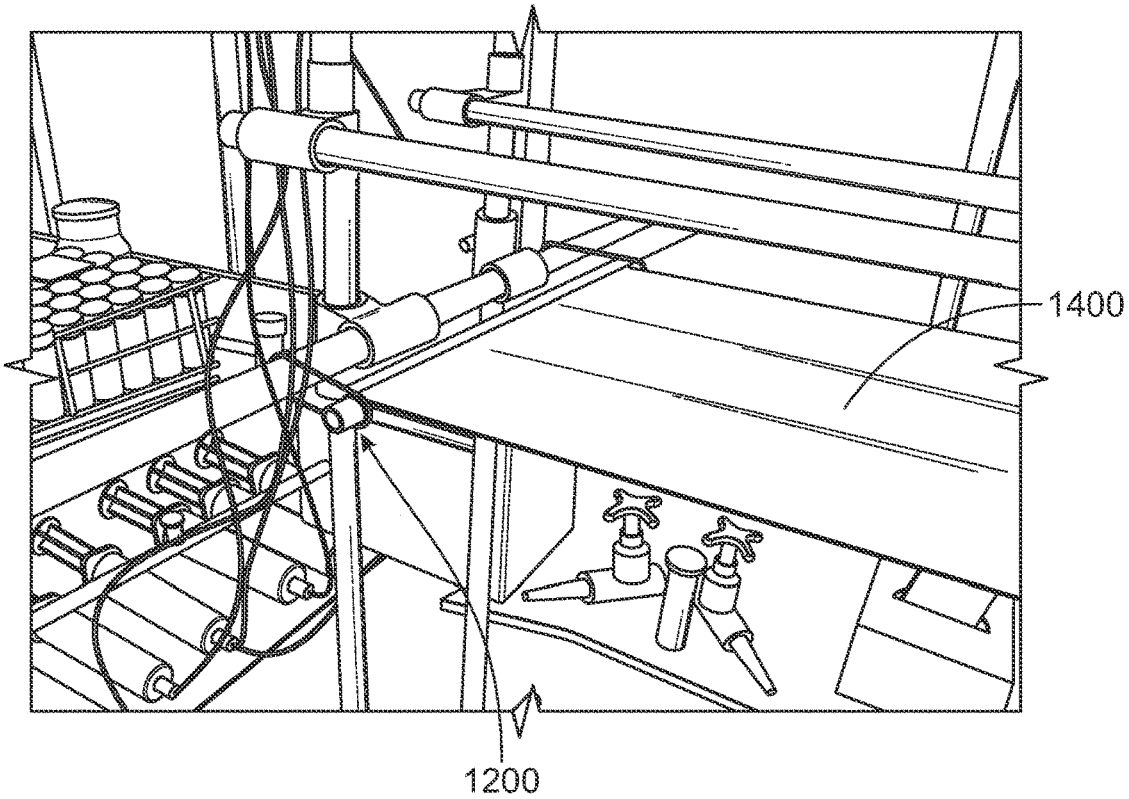
Figure 16:
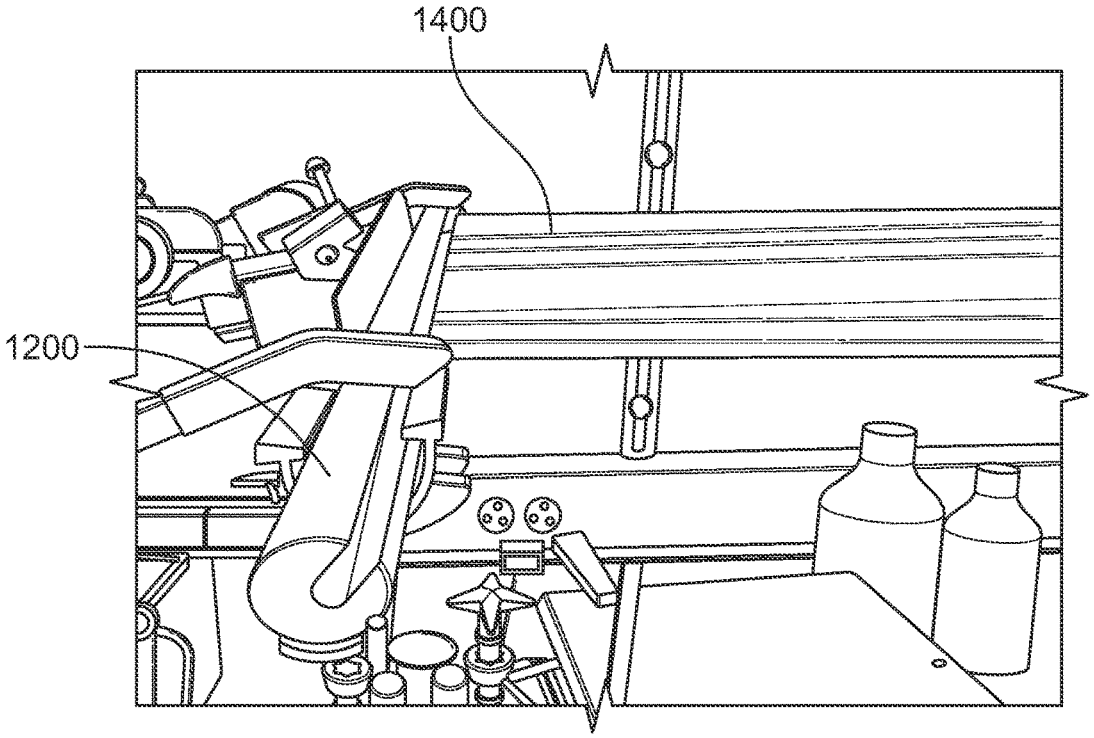
Figure 17:
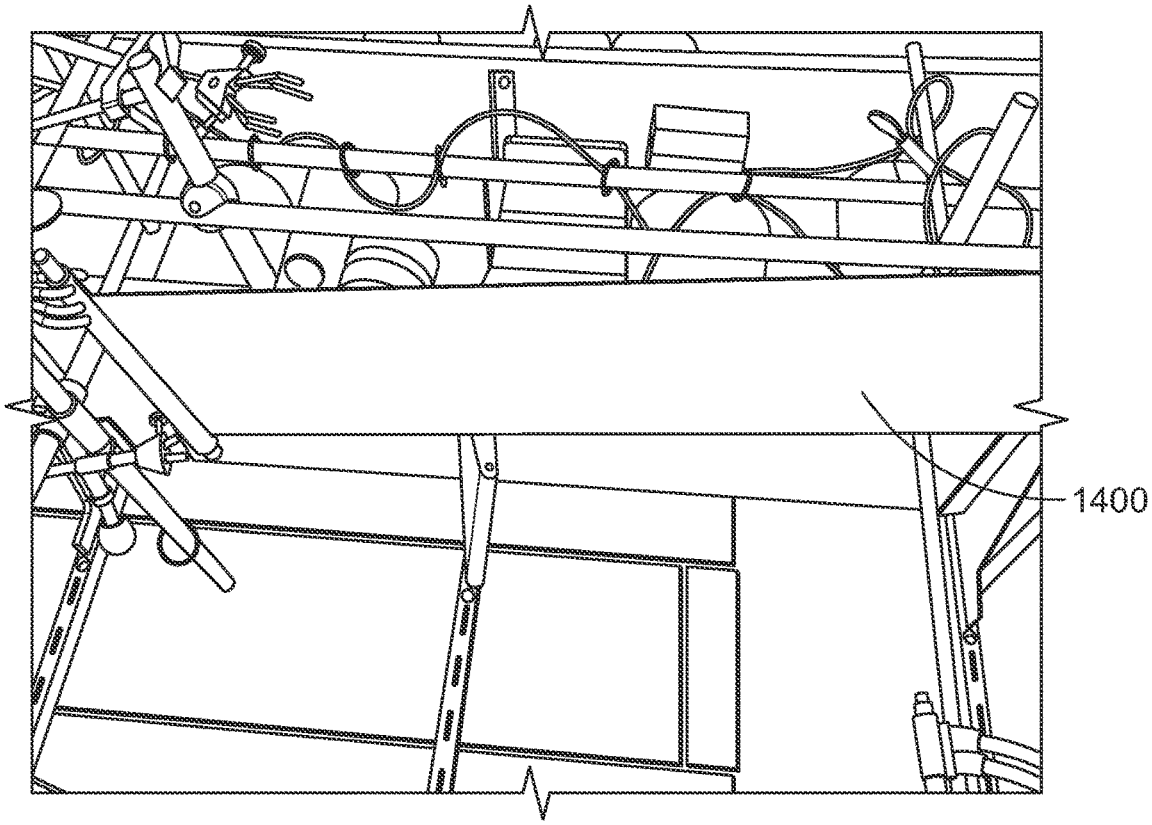

A flexible film was tensioned and held at a slope between two manifolds as illustrated in various view in FIGS. 12-17. FIG. 12 shows a side view of the testing apparatus used to perform the controlled experiments. FIG. 13 shows a close up view of the bottom and side of the manifold 1200 used to tension the film, collect condensate, and release condensate transported by the top and bottom microchannels in the film. FIG. 14 shows a view of the test apparatus looking down onto the top of the film 1400. FIGS. 15 and 16 show the top and side views of the manifold 1200 illustrating the film 1400 attached to the manifold 1200. FIG. 17 is a bottom view of the film 1400. As illustrated in FIGS. 12-17, the manifolds were held by a jig and could be repositioned to change the slope. Droplets were dropped onto the upper surface of the film at a controlled dispensed rate to simulate condensate falling from a condensate producing surface. An atomizer was used to produce condensation droplets on the bottom surface of the film. The condensate was transported into the manifold and released from a single collection point. The amount of condensate that was collected by the film and manifold was weighed.

Example 1

The mass of condensate collected and the angle at which underside condensation dripped prior to reaching the manifold was tested at various slopes of a tensioned capillary film. The data provided in Table 1 indicates that a hydrophilic capillary film with 0 degree oriented channels can transport underside condensation 930 mm at a slope of −3 degrees without releasing condensate prior to reaching the manifold. However, at a slope of −1.7, degrees, the same film releases (drips) condensate before reaching the manifold.

TABLE 1

| Trial # | Slope (degrees, angle) | Mass (g/5 min) | Right Height (mm) | Left Height (mm) | Length of Film (mm) | Atomizer Air Pressure (FPM) | Steady State Dripping before reaching manifold (Y or N) | Temp/Humidity |
|---|---|---|---|---|---|---|---|---|
| 1 | 6 | 3.66 | 18 | 115 | 930 | 5 | N | 72 F./31% RH |
| 2 | 6 | 3.44 | 18 | 115 | 930 | 5 | N | |
| 3 | 6 | 3.37 | 18 | 115 | 930 | 5 | N | |
| 4 | 6 | 3.86 | 18 | 115 | 930 | 5 | N | |
| 5 | 6 | 3.90 | 18 | 115 | 930 | 5 | N | |
| 6 | 6 | 4.00 | 18 | 115 | 930 | 5 | N | |
| | | NOTE: Decreased slope | | | | | | |
| 17 | 4.7 | 3.80 | 18 | 94 | 930 | 5 | N | |
| 8 | 4.7 | 3.53 | 18 | 94 | 930 | 5 | N | |
| 9 | 4.7 | 3.41 | 18 | 94 | 930 | 5 | N | |
| 10 | 4.7 | 3.51 | 18 | 94 | 930 | 5 | N | |
| | | NOTE: Decreased slope | | | | | | |
| 11 | 3 | 3.59 | 18 | 67 | 930 | 5 | N | 70 F./35% RH |
| 12 | 3 | 3.70 | 18 | 67 | 930 | 5 | N | |
| 13 | 3 | 3.53 | 18 | 67 | 930 | 5 | N | |
| 14 | 3 | 3.36 | 18 | 67 | 930 | 5 | N | |
| 15 | 3 | 3.63 | | | | | | |
| | | NOTE: Decreased slope | | | | | | 70 F./36% RH |
| 16 | 1.7 | NA | 18 | 45 | 930 | 5 | Y | |

Example 2

Various materials were evaluated to determine how far the materials could transport underside condensate at a slope of −1.3 degrees before dripping prior to reaching the manifold. Table 2 summarizes the results.

TABLE 2

| Trial# | Material | Slope (degrees) | Avg distance before dripping (mm) (10 drops) | Toughing (yes/no) | Length of Film (mm) | Atomizer air Pressure (fpm) | Drop Left to right (mm) | Temp/ Humidity | Anisotropic isotropic |
|---|---|---|---|---|---|---|---|---|---|
| 1 | 3M PI Membrane | 1.30 | 47.8/3:45 min | No | 930 | 5 | 33/12 | 72 F./34% RH | A |
| 1 | Micro capillary film/Manifold tilt | 1.30 | 39.0/6:25 min | No | 930 | 5 | 33/12 | 71 F./37% RH | I |
| 1 | 50/50 Texel | 1.30 | Sagged when wet, NA | Yes (bowing) | 930 | 5 | 33/12 | 70 F./36% RH | A |
| 1 | Cerex AF, PBN II 2.0osy | 1.30 | Slightly sagged when wet, over-stretched 13.7/3:45 | Yes | 930 | 5 | 33/12 | 72 F./36% RH | A |

TABLE 2-continued

| Trial# | Material | Slope (degrees) | Avg distance before dripping (mm) (10 drops) | Toughing (yes/no) | Length of Film (mm) | Atomizer air Pressure (fpm) | Drop Left to right (mm) | Temp/ Humidity | Anisotropic isotropic |
|---|---|---|---|---|---|---|---|---|---|
| 1 | Fiberweb | 1.30 | Hydrophobic, dripped immediately 0 | No | 930 | 5 | 33/12 | 72 F./36% RH | NA |
| 1 | American Nonwoven 33.5gsm | 1.30 | Low capillary force 5/1.5 min | No | 930 | 5 | 33/12 | 72 F./36% RH | A |

Cerex Advanced Fabrics, Nylon 6,6 PA Spunbond/Chem Bond 68 gsm hydrophilic material stretched when it got wet and sagged (6 cm at mid point) over distance (94 cm) creating a low spot where steady state dripping was observed. Therefore materials that swell or stretch when water contacts and sagging occurs will fail at transporting condensate to the manifold device.

Fiberweb Style #T0505 PP Spunbond/Meltblown/spunbond 15.6 gsm hydrophobic nonwoven did not transport water and steady state dripping was observed immediately. The example demonstrates the need for hydrophilic capillary materials in this system.

American Nonwoven Style RB-316-28-G/R, 25% PET/75% Rayon Carded/Resin Bond 33.5 gsm nonwoven did not have a sufficient capillary force to transport set SFPM flow rate and steady state dripping was observed quickly where the aerosolized water contacted the sample.

Example 3

Figure 18:
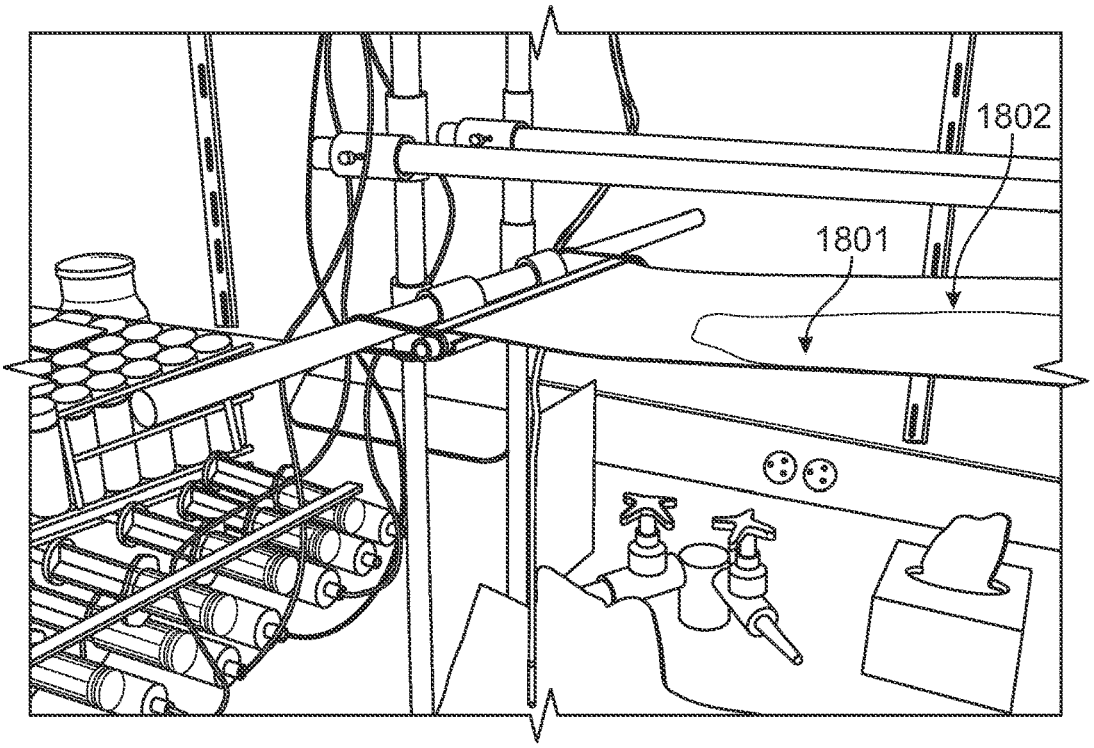
FIG. 18 is a photograph of a hydrophobic flat film installed in the test apparatus showing "fingering" and pooling of condensate.

A comparative example illustrates what occurs when hydrophobic flat films are utilized for collection and transport. FIG. 18 shows that when hydrophobic flat films are used, "fingering" (indicated by arrow 1801) of liquid is sporadic and may lead water to fall of edges of film prior to reaching manifold which is a failure mechanism. Further pooling (indicated by arrow 1802) can create sag in materials and also lead to release of liquid prior to manifold.

Embodiments disclosed herein include:

Embodiment 1

A condensation management manifold comprising:

a first portion including a first elongated channel comprising a first condensate flow channel; and a second portion including a second elongated channel comprising a second condensate flow channel, the second portion configured to nest at least partially within the first portion such that a first surface of a flexible condensate management film is fluidically coupled to the first flow channel and an oppositely oriented second surface of the condensate management film is fluidically coupled to the second flow channel.

Embodiment 2

The manifold of embodiment 1, wherein when the second portion is nested within the first elongated channel of the first portion, the second portion and the first elongated channel provide a friction clamp that attaches an end of the flexible condensate management film to the manifold.

Embodiment 3

The manifold of embodiment 2, wherein the friction clamp is configured to clamp a flexible condensate management film having a thickness of between about 50 microns and about 1000 microns.

Embodiment 4

The manifold of embodiment 2, wherein the friction clamp is a reversible friction clamp that allows the condensate management film to be attached and subsequently detached from the manifold without substantial damage to the film or the manifold.

Embodiment 5

The manifold of embodiment 2, wherein, in cross section, the first elongated channel includes a first section configured to provide the friction clamp and a second section that forms the first condensate flow channel.

Embodiment 6

The manifold of embodiment 2, wherein, in cross section, the first section of the first elongated channel includes two curved sides that are separated by the first flow channel.

Embodiment 7

The manifold of embodiment 6, wherein each of the two curved sides comprise a portion of a circle.

Embodiment 8

The manifold of any of embodiments 1 through 7, wherein, in cross section, the second elongated channel is an incomplete circle.

Embodiment 9

The manifold of any of embodiments 1 through 8, further comprising one or more drain grooves between the first portion and the second portion of the manifold, the one or more drain grooves configured to allow condensate from the film to enter the first condensate flow channel.

Embodiment 10

The manifold of embodiment 9, wherein the drain grooves are disposed on an inner surface of the first elongated channel.

Embodiment 11

The manifold of embodiment 9, wherein the drain grooves are disposed on an outer surface of the second portion that nests within the first portion.

Embodiment 12

The manifold of any of embodiments 1 through 11, wherein a length of the first portion and a length of the second portion is between about 5 inches and about 36 inches.

Embodiment 13

The manifold of any of embodiments 1 through 12, wherein a maximum inner width of the first elongated channel is between about 4 millimeters and about 20 millimeters.

Embodiment 14

The manifold of any of embodiments 1 through 13, wherein a maximum inner width of the second elongated channel is between about 4 millimeters and about 16 millimeters.

Embodiment 15

The manifold of any of embodiments 1 through 14, wherein:

the first portion includes a first end and a second end with the first elongated channel disposed between the first and second ends of the first portion;

the second portion includes a first end and a second end with the second elongated channel disposed between the first and second ends of the second portion; and the first portion and the second portion are attached together by a hinge at the first end of the first portion and the first end of the second portion.

Embodiment 16

The manifold of any of embodiments 1 through 15, wherein each of the first and second channels are substantially straight along a longitudinal axis of the manifold.

Embodiment 17

The manifold of any of embodiments 1 through 16, wherein the first portion includes a third condensate flow channel fluidically coupled to the first surface of the flexible condensate management film.

Embodiment 18

A condensation management system comprising:

a condensation management manifold;

a condensation management film support; and a flexible condensation management film disposed between the manifold and the support, the condensation manifold comprising:

a first portion including a first elongated channel comprising a first condensate flow channel; and a second portion including a second elongated channel comprising a second condensate flow channel, the second portion configured to nest within the first elongated channel such that a first surface of the film is fluidically coupled to the first channel and an oppositely oriented second surface of the film is fluidically coupled to the second channel.

Embodiment 19

The system of embodiment 18, wherein the condensation management film support comprises a second condensation management manifold.

Embodiment 20

The system of any of embodiments 18 through 19, wherein the flexible condensation management film includes microchannels disposed in one or both of the first surface and the second surface of the film.

Embodiment 21

The system of embodiment 20, wherein the flexible condensation management film channels are capillary channels configured to wick condensate against the force of gravity.

Embodiment 22

The system of any of embodiments 18 through 21, wherein the film slopes downward from the support toward the manifold.

Embodiment 23

The system of claim 18, further comprising a hydrophilic layer or hydrophilic surface structure disposed on one or both surfaces of the condensate management film.

Embodiment 24

The system of any of embodiments 18 through 23, further comprising at least one mount mechanically coupled to the manifold, the mount configured to position and hold the manifold relative to a condensate producing surface such that condensate that forms on the condensate producing surface falls from the condensate producing surface onto a surface of the film.

Embodiment 25

The system of embodiment 24, wherein the mount thermally decouples the manifold from the condensate producing surface.

Embodiment 26

The system of embodiment 24, wherein the mount is mechanically coupled to the manifold by a spring.

Embodiment 27

The system of any of embodiments 18 through 26, wherein:

the manifold comprises a first end and a second end with the first and second longitudinal channels disposed between the first end and the second end; and further comprising:

a first mount mechanically coupled to the first end of the manifold; and a second mount mechanically coupled to the second end of the manifold, the first and second mounts configured to position and hold the manifold relative to the condensate producing surface such that condensate that forms on the condensate producing surface falls from the condensate producing surface onto the first surface of the film.

Embodiment 28

The system of embodiment 27, wherein:

the first end of the manifold is mechanically coupled to the first mount by a first resilient element; and the second end of the manifold is mechanically coupled to the second mount by a second resilient element.

Embodiment 29

A condensation management system comprising:

a trapezoidal flexible condensation management film having a plurality of attachment features; and a plurality of mounts respectively coupled to the plurality of attachment features of the flexible condensation management film, the mounts configured to position and hold the film relative to a condensate producing surface such that the film is curved along a lateral axis of the film and a bottom of the curved condensate management film slopes downward along the direction of gravity.

Embodiment 30

The system of embodiment 29, wherein the sides of the curved condensate management film are oriented substantially perpendicular with respect to the direction of gravity.

Embodiment 31

The system of any of embodiments 29 through 30, wherein:

each mount includes an attachment element configured to couple to an attachment feature of the condensate management film;

the attachment element of the mount is a hook; and the attachment feature of the film is a hole in the condensate management film.

Embodiment 32

The system of embodiment 31, wherein each mount includes a base portion and a resilient element disposed between the base portion and the attachment feature.

Embodiment 33

The system of any of embodiments 29 through 32, wherein the condensate management film includes capillary microchannels.

Embodiment 34

The system of any of embodiments 29 through 33, further comprising a hydrophilic layer or hydrophilic surface structure disposed on one or both surfaces of the condensate management film.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Various modifications and alterations of these embodiments will be apparent to those skilled in the art and it should be understood that this scope of this disclosure is not limited to the illustrative embodiments set forth herein. For example, the reader should assume that features of one disclosed embodiment can also be applied to all other disclosed embodiments unless otherwise indicated.

The invention claimed is:

1. A condensation management manifold comprising:

a first portion including a first elongated channel comprising a first condensate flow channel; and a second portion including a second elongated channel comprising a second condensate flow channel, the second portion configured to nest at least partially within the first portion such that a first surface of a flexible condensate management film is fluidically coupled to the first flow channel and an oppositely oriented second surface of the condensate management film is fluidically coupled to the second flow channel;

wherein when the second portion is nested within the first elongated channel of the first portion, the second portion and the first elongated channel provide a friction clamp that attaches an end of the flexible condensate management film to the manifold.

2. The manifold of claim 1, wherein the friction clamp is configured to clamp a flexible condensate management film having a thickness of between 50 microns and 1000 microns.

3. The manifold of claim 1, wherein the friction clamp is a reversible friction clamp that allows the condensate management film to be attached and subsequently detached from the manifold without substantial damage to the film or the manifold.

4. The manifold of claim 1, wherein, in cross section, the first elongated channel includes a first section configured to provide the friction clamp and a second section that forms the first condensate flow channel.

5. The manifold of claim 1, wherein, in cross section, the first section includes two curved sides that are separated by the first flow channel.

6. The manifold of claim 5, wherein each of the two curved sides comprise a portion of a circle.

7. The manifold of claim 1, wherein, in cross section, the second elongated channel is an incomplete circle.

8. The manifold of claim 1, further comprising at least one or more drain grooves between the first portion and the second portion of the manifold, the at least one or more drain grooves configured to allow condensate from the film to enter the first condensate flow channel.

9. The manifold of claim 8, wherein the drain grooves are disposed on an inner surface of the first elongated channel.

10. The manifold of claim 8, wherein the drain grooves are disposed on an outer surface of the second portion that nests within the first portion.

11. The manifold of claim 1, wherein a length of the first portion and a length of the second portion is between 5 inches and 36 inches.

12. The manifold of claim 1, wherein a maximum inner width of the first elongated channel is between 4 millimeters and 20 millimeters.

13. The manifold of claim 1, wherein a maximum inner width of the second elongated channel is between 4 millimeters and 16 millimeters.

14. The manifold of claim 1, wherein:

the first portion includes a first end and a second end with the first elongated channel disposed between the first and second ends of the first portion;

the second portion includes a first end and a second end with the second elongated channel disposed between the first and second ends of the second portion; and the first portion and the second portion are attached together by a hinge at the first end of the first portion and the first end of the second portion.

15. The manifold of claim 1, wherein each of the first and second channels are substantially straight along a longitudinal axis of the manifold.

16. The manifold of claim 1, wherein the first portion includes a third condensate flow channel fluidically coupled to the first surface of the flexible condensate management film.

* * * * *